US008015904B2

(12) United States Patent
Kapolnek et al.

(10) Patent No.: US 8,015,904 B2
(45) Date of Patent: Sep. 13, 2011

(54) DIE HOLDER ASSEMBLY FOR ROTARY CUTTING SYSTEM

(75) Inventors: Paul G. Kapolnek, Chicago, IL (US); Timothy G. Kapolnek, Stickney, IL (US); David J. Kapolnek, Park Ridge, IL (US); Michael K. Musgrave, Chicago, IL (US); Diane Peters, Des Plaines, IL (US); Kent M. Troxel, Highland, IN (US)

(73) Assignee: Western Printing Machinery Company, Schiller Park, IL (US)

( * ) Notice: Subject to any disclaimer, the term of this patent is extended or adjusted under 35 U.S.C. 154(b) by 559 days.

(21) Appl. No.: 11/246,008

(22) Filed: Oct. 7, 2005

(65) Prior Publication Data

US 2006/0096431 A1 May 11, 2006

Related U.S. Application Data

(60) Provisional application No. 60/616,998, filed on Oct. 8, 2004.

(51) Int. Cl.
*B26D 1/62* (2006.01)

(52) U.S. Cl. ..... 83/343; 83/698.41

(58) Field of Classification Search .. 83/698.41–698.61, 83/529, 343, 346, 670
See application file for complete search history.

(56) References Cited

U.S. PATENT DOCUMENTS

| | | | | | |
|---|---|---|---|---|---|
| 487,894 | A | * | 12/1892 | Shields | 83/681 |
| 1,411,774 | A | | 4/1922 | Engel | |
| 1,861,456 | A | * | 6/1932 | Shaw et al. | 83/669 |
| 2,034,161 | A | | 3/1936 | Thiel | |
| 2,100,847 | A | * | 11/1937 | Halstead | 83/143 |
| 2,801,694 | A | * | 8/1957 | Schneider et al. | 83/675 |
| 3,030,841 | A | * | 4/1962 | Haas | 83/672 |
| 3,128,663 | A | * | 4/1964 | Dovey | 83/669 |
| 3,188,900 | A | * | 6/1965 | Mauro | 83/663 |
| 3,589,230 | A | * | 6/1971 | Neuman | 83/669 |
| 3,752,042 | A | * | 8/1973 | Castille | 493/471 |
| 3,857,314 | A | * | 12/1974 | Gregoire | 83/346 |
| 3,926,084 | A | * | 12/1975 | Blazer | 83/698.41 |
| 3,935,774 | A | | 2/1976 | Craddy | 83/355 |
| 4,014,234 | A | | 3/1977 | Spengler | 83/162 |

(Continued)

FOREIGN PATENT DOCUMENTS

| | | |
|---|---|---|
| GB | 1044313 | 9/1966 |

(Continued)

*Primary Examiner* — Kenneth E. Peterson
(74) *Attorney, Agent, or Firm* — Brinks Hofer Gilson & Lione

(57) ABSTRACT

The present invention provides a die holder with one or more pre-located recessed areas or voids into which cutting dies can be quickly and easily inserted and secured. The die holder mounts quickly to the cylinder, and can be quickly removed for alternative operations. The die holder can be made according to the operator needs for different types, sizes and positions of dies. Unused voids can be filled with 'blank' blocks to achieve a consistent or uniform surface height for the full 360 degree area of the die cylinder. The present invention further provides a removable scrap control apparatus that is not attached permanently to the die cylinder on which it is used, which permits the use of a multiple blade die or a plurality of single blade dies on the same die cylinder without requiring permanent holes, slots or other means to accommodate the scrap control apparatus on the die cylinder or anvil cylinder.

19 Claims, 32 Drawing Sheets

U.S. PATENT DOCUMENTS

| | | | | | |
|---|---|---|---|---|---|
| 4,020,724 | A | * | 5/1977 | Quinlan | 83/346 |
| 4,823,659 | A | * | 4/1989 | Falasconi | 83/100 |
| 5,088,367 | A | * | 2/1992 | Cracchiolo et al. | 83/345 |
| 5,159,868 | A | * | 11/1992 | Thomas et al. | 83/674 |
| 5,226,344 | A | * | 7/1993 | Rosemann | 83/674 |
| 5,394,779 | A | | 3/1995 | Meeks | 83/332 |
| 5,570,620 | A | * | 11/1996 | Okonski et al. | 83/152 |
| 5,782,156 | A | * | 7/1998 | Collins | 83/331 |
| 5,893,314 | A | * | 4/1999 | Kapolnek et al. | 83/698.41 |
| 6,266,992 | B1 | * | 7/2001 | Butcher et al. | 72/478 |
| 7,096,709 | B2 | * | 8/2006 | Hutchison et al. | 72/482.94 |
| 2002/0011140 | A1 | * | 1/2002 | Okonski et al. | 83/698.41 |

FOREIGN PATENT DOCUMENTS

| | | |
|---|---|---|
| GB | 2 247 205 | 2/1992 |
| GB | 2 337 224 | 11/1999 |

* cited by examiner

LOCKED POSITION

UNLOCKED POSITION

DIE HOLDER ASSEMBLY FOR ROTARY CUTTING SYSTEM

CROSS-REFERENCE TO RELATED APPLICATIONS

This application is a non-provisional application which claims the priority of U.S. Provisional Application Ser. No. 60/616,998, filed Oct. 8, 2004, the contents of which are hereby incorporated by reference.

TECHNICAL FIELD

This invention relates generally to rotary cutters for cutting web or sheet material, and more particularly to an improved means of quickly and securely attaching rotary cutting dies and knives (dies) to, and removing them from rotary, cutting machines, as well as an improved apparatus for removing scrap that is cut from the web material.

BACKGROUND

Conventional methods of attaching dies to cutting machines require the step of positioning dies individually on the die cylinder, and then using several fastening screws to secure each die to the die cylinder. The type and style of die used must be compatible with the cutting machine for proper operation. Attaching and removing conventional dies is a time consuming process, and incorporating into the dies the hardware necessary to mount conventional dies adds to the expense of manufacturing these dies.

For effective operation, conventional methods also require attaching layers of rubber between each of the mounted dies to provide a consistent surface height around the circumference of the die cylinder.

Current systems also use various mechanisms built in to the rotary cutting machine, such as holes or slots in the anvil cylinder, to remove scrap from the web material being cut. As needed, pins are inserted into and removed from holes in the die cylinder. This adds to the time required to prepare a cutting machine for operation.

BRIEF SUMMARY

The present invention provides a die holder with one or more pre-located voids into which cutting dies can be quickly and easily inserted and secured. The die holder mounts quickly to the cylinder, and can be quickly removed for alternative operations. The die holder can be made according to the operator needs for different types, sizes and positions of dies. Multiple die holders do not require a die locating system. Unused voids can be filled with 'blank' blocks to achieve a consistent or uniform surface height for the full 360 degree area of the die cylinder. Accordingly, there is no need to add rubber or bridging blocks to fill any gaps between each of the dies.

The die holder according to the present invention is superior to current methods of mounting dies on rotary cutting machines for a variety of reasons. It provides a way to more quickly and securely attach rotary cutting dies to, and remove them from, rotary cutting machines. It may be used for various styles of dies and various styles of rotary cutting machines. It may be used as an adaptor for using various dies on otherwise incompatible machines, including those of different styles and manufacturers. And it allows for the use of simpler and less costly to manufacture dies. For example, it eliminates the need for special machine mounting features, such as reinforced holes, that are required on conventionally mounted dies, as well as reducing the thickness of die base material required.

The present invention also provides a die holder with a base extending circumferentially around the cylinder, thereby bridging the gaps between dies and providing a consistent surface height around the 360 degree surface of the cylinder in order to reduce or eliminate the normal need for adding rubber or bridging blocks to the cylinder. The die holder can be configured to accommodate multiple, pre-positioned dies to simplify knife positioning and further reduce set up time. Blank (no blade) dies can be used in place of cutting dies where cutting is not needed in a die holder configured to accommodate multiple dies.

The die holder according to the present invention increases the cutting life of the die, reduces the sound level of the cutting process, and is lighter weight than a comparable conventional die.

The present invention further provides a removable scrap control apparatus that is not attached permanently to the die cylinder on which it is used, which permits the use of a multiple blade die or a plurality of single blade dies on the same die cylinder without requiring permanent holes, slots or other means to accommodate the scrap control apparatus on the die cylinder or anvil cylinder. Nor does the scrap control apparatus require pins in the cylinder.

BRIEF DESCRIPTION OF THE DRAWINGS

FIG. 21 is a configured shape cut-out die with a flexible bowed stripper band.

DETAILED DESCRIPTION OF THE DRAWINGS AND THE PRESENTLY PREFERRED EMBODIMENTS

Figure 30:
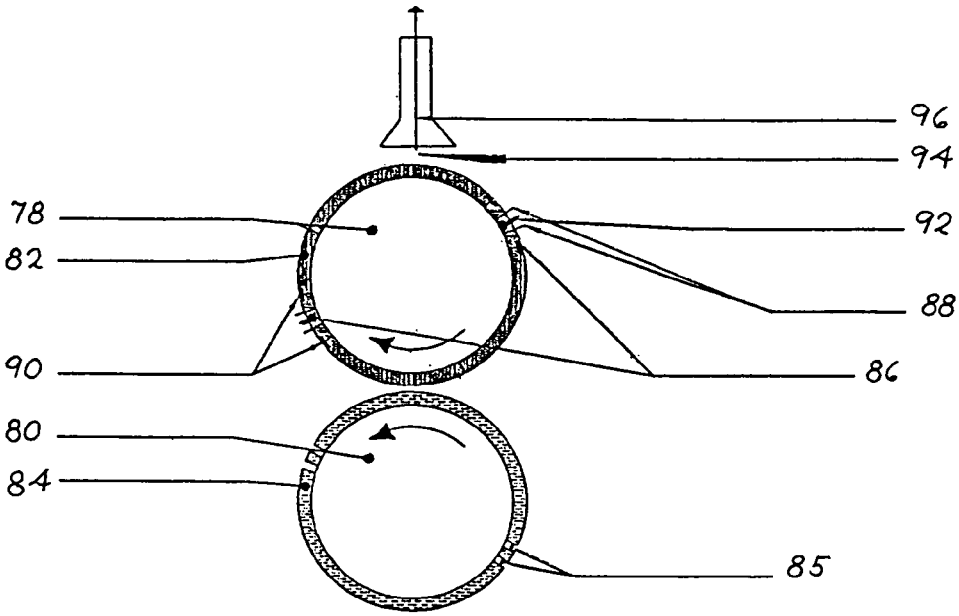
FIG. 30 is a side view of die holders and dies with scrap removal mechanisms. These are shown mounted on a die cylinder, with an anvil cylinder and a scrap removal chute.
Figure 31:
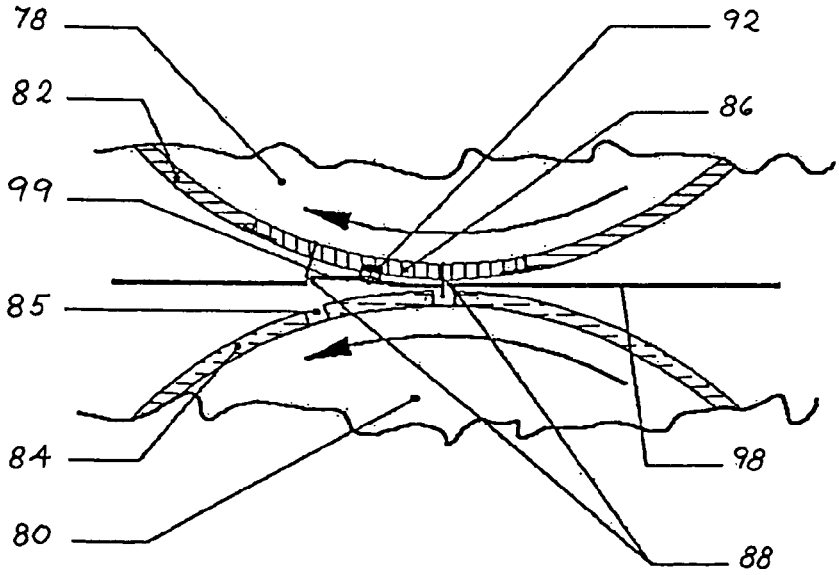
FIG. 31 is a side view of die holders and dies with scrap removal mechanisms. These are shown mounted on a die cylinder, cutting a web of material against an anvil cylinder.

Referring to FIG. 30, there is shown a die cylinder 78, with an anvil cylinder 80, a stripper comb 94, and a scrap removal chute 96. The web material (not shown) passes between the nip formed between the two cylinders. Die holders 82, dies 86, and scrap removal mechanisms 92 are shown mounted on a die cylinder 78. A resilient material 84 is covering the anvil cylinder except for the gaps 85 corresponding to the die blades 92 on die cylinder 78. FIG. 31 shows an enlarged partial side sectional view of die holder 82, die 86 and scrap removal mechanism 92, which are mounted on die cylinder 78. A web of material 98 is cut by die blades 88. The web material scrap 99 is impaled by scrap removal mechanism 92.

FIGS. 1, 2, 3 and 4 show a perspective, top, cross sectional and side view, respectively, of a cutting die with a base 14 and blades 16. The die is inserted into a cutout 5 of a base of die holder 2, and secured with locking bars 12 and fasteners 8. Locking bars 12 are set in indentations 6 of base of die holder 2. Fasteners 8 extend through openings 10 in the locking bar and openings 9 in the base of die holder 2. Fasteners through holes 4 in the base 2 of the die holder are used to mount the base 2 to die cylinder 78. A locking bar lip 20 fits into a notch 18 in the die base edge to secure the position of locking bar 12 and die base 14.

FIGS. 5, 6, 7 and 8 show a perspective, top, cross sectional and side view, respectively, of cutting dies 21, similar to the cutting die shown in FIGS. 1-4, that are inserted into multiple cutouts 23 of a base of a die holder 22 that extends around half of the circumference of cylinder 78. A blank 24 is inserted in one cutout in place of a cutting die 21.

FIGS. 9, 10, 11 and 12 show a perspective, top, end and side view, respectively, of a cutting and perforating die, similar to the cutting dies shown in FIGS. 1-8, which is mounted to a base of a die holder adaptor 26. Contours 28 in the base of the die holder adaptor are configured to fit the shape of the base of a die 25.

FIGS. 13, 14, 15 and 16 show a perspective, top, cross sectional and side view, respectively, of a tuck-in style die 36 that is inserted into a cutout 31 of a base of a die holder 30. An edge 35 of die 36 tucks into an indentation 38 in a base of die holder 30. Another edge 37 of die 36 is secured by a locking bar 32, which is pushed into place and reinforced by springs 34.

Figure 28:
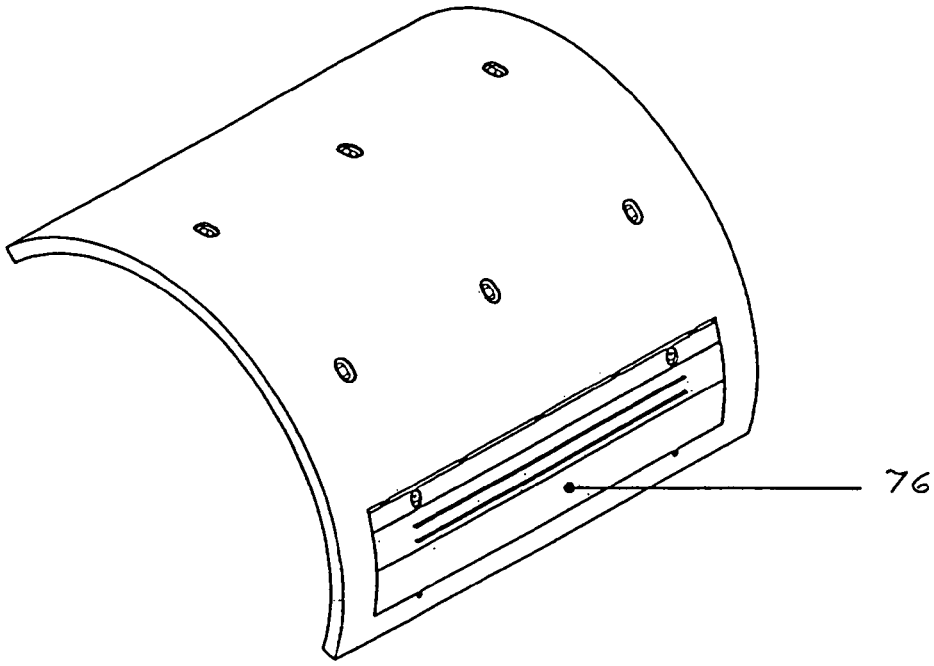
FIG. 28 is a perspective view of a die holder with a tuck-in die and a spacer bar.
Figure 29:
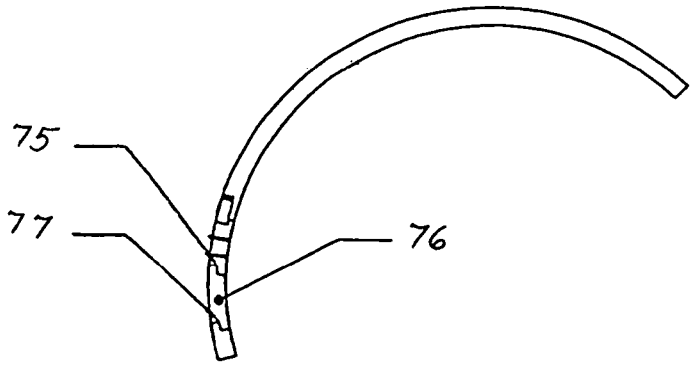
FIG. 29 is an end view of die holder with a tuck-in die and a spacer bar.

FIG. 28 shows a perspective view and FIG. 29 shows an end view of a spacer 76 and a tuck-in style die, similar to the style in FIGS. 13-16. Spacer 76 fits securely between a contour edge 75 of the die and a contour edge 77 of the die holder.

FIGS. 45, 46, 47 and 48 show a perspective, top, cross sectional and side view, respectively, of another tuck-in style die 136 in a die holder 134. An edge 135 of die 136 is tucked into an indentation 139 in die holder 134. Another edge 137 of die 136 is secured by a locking bar 138 which is secured by a locking screw 140.

FIGS. 17, 18, 19 and 20 show a perspective, top, cross sectional and side view, respectively, of a snap-in style die 42 that is inserted into a cutout 41 of a base of a die holder 40. Contoured edges 44 of die 42 fit securely into and around contoured edges 46 of die holder 40.

Figure 26:
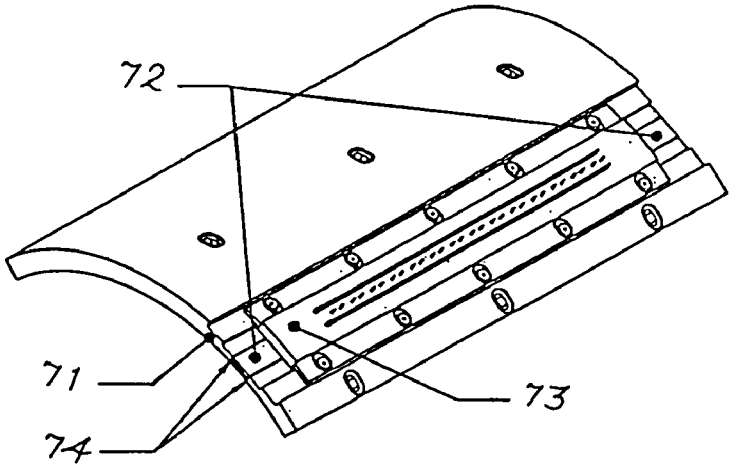
FIG. 26 is a perspective view of a die holder adaptor with a blade backer strip.
Figure 27:
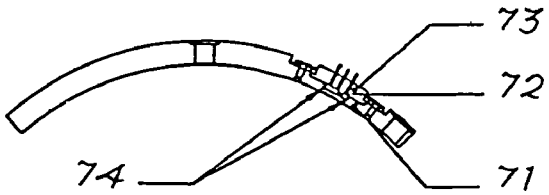
FIG. 27 is an end view of die holder adaptor with blade backer strip.

FIG. 26 shows a perspective view and FIG. 27 shows an end view of a cutting die 73 with a blade backer strip 72 fit into an indentation 74 of the base of a die holder adaptor 71.

FIG. 21 shows a perspective view of a contour cutting die with a base 48, a blade 50, and a flexible, pointed, bowed stripper band 52 arcing away from the die base. A point 54 is at the peak of the arc. Slotted ends 56 of stripper band 52 fit securely under and around fasteners 58.

Figure 1:
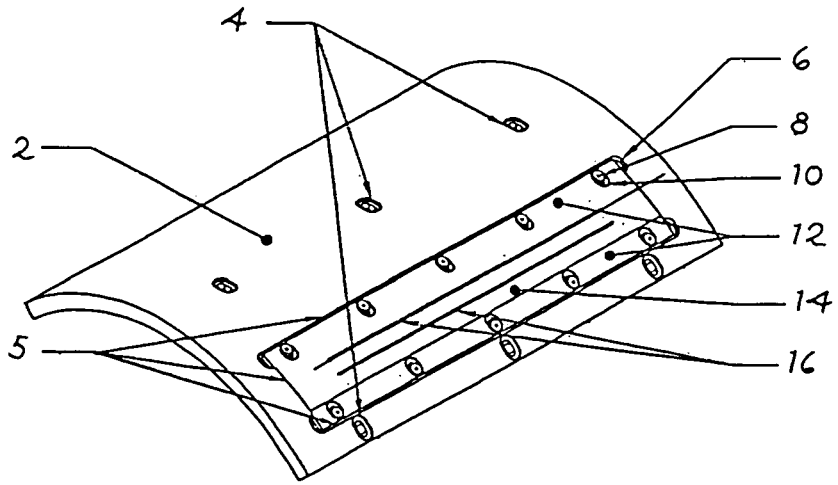
FIG. 1 is a prospective view of a die holder with sliding lock bars and inserted die.
Figure 2:
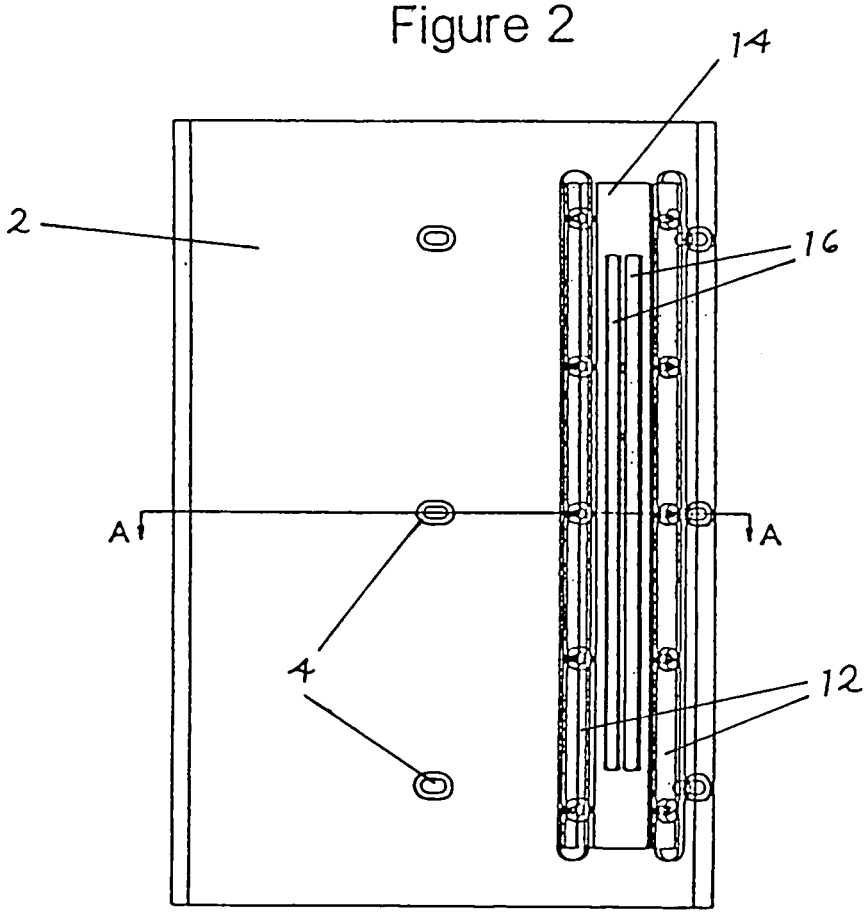
FIG. 2 is a top view of die holder with sliding lock bars and inserted die.
Figure 3:
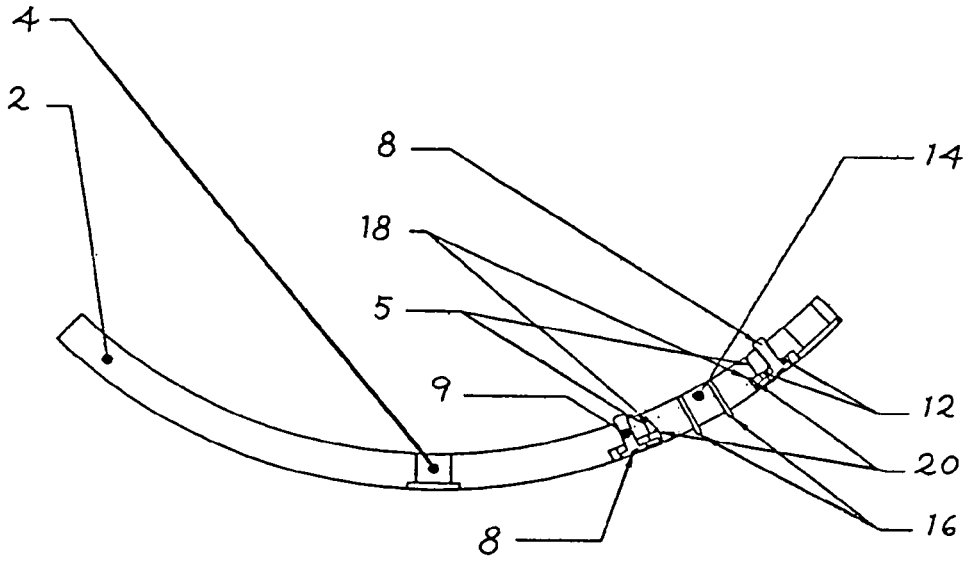
FIG. 3 is a cross sectional view of die holder with sliding lock bars and inserted die taken along line A-A of FIG. 2.
Figure 4:
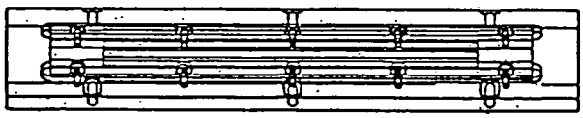
FIG. 4 is a side view of die holder with sliding lock bars and inserted die.
Figure 5:
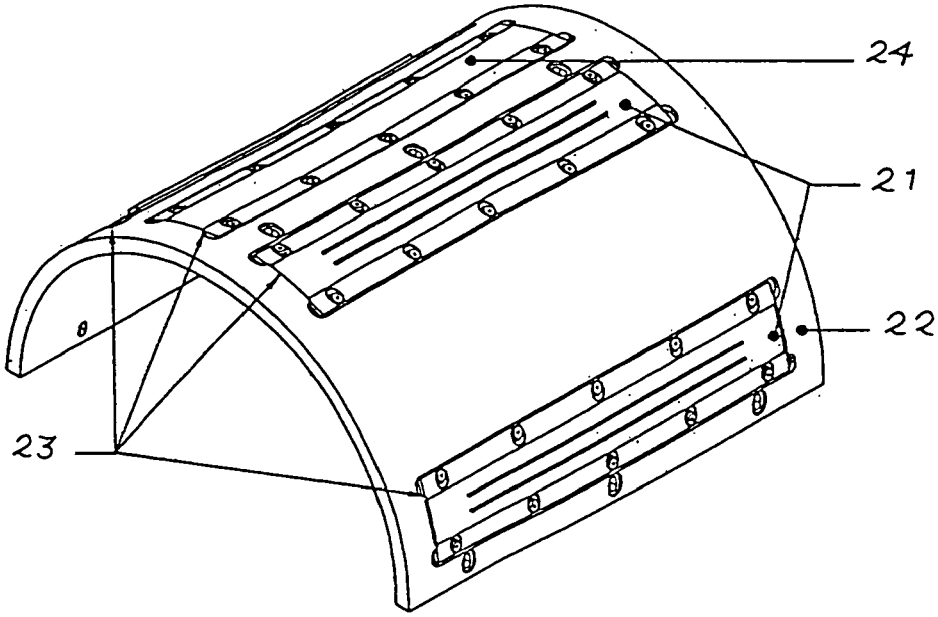
FIG. 5 is a prospective view of an extended, half circumference die holder with sliding lock bars and inserted dies.
Figure 6:
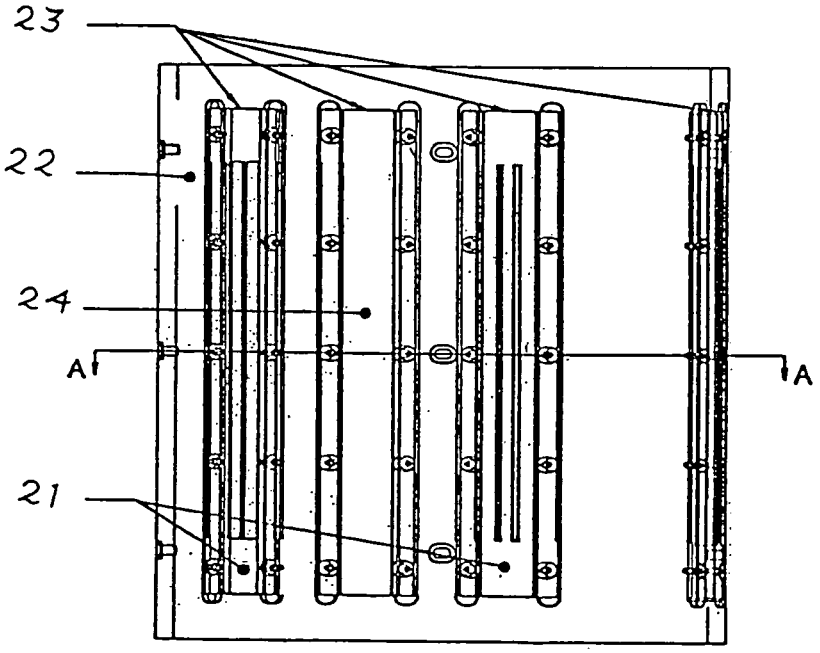
FIG. 6 is a top view of extended, half circumference die holder with sliding lock bars and inserted dies.
Figure 7:
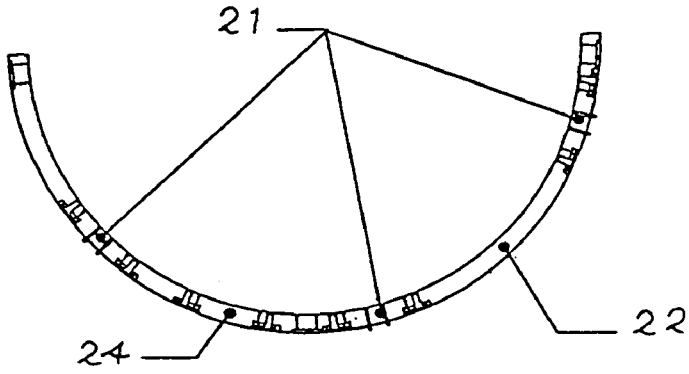
FIG. 7 is a cross sectional view of extended, half circumference die holder with sliding lock bars and inserted dies taken along line A-A of FIG. 6.
Figure 8:
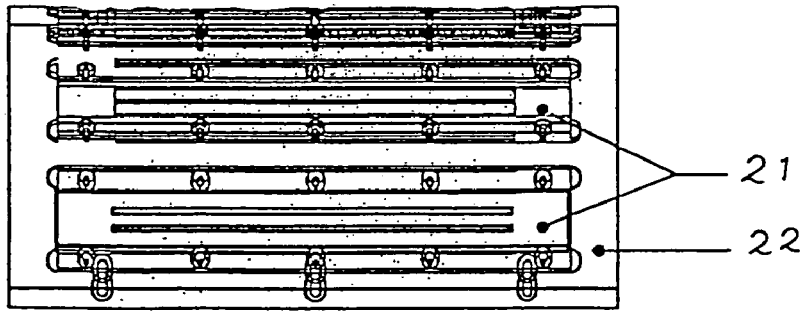
FIG. 8 is a side view of extended, half circumference die holder with sliding lock bars and inserted dies.
Figure 9:
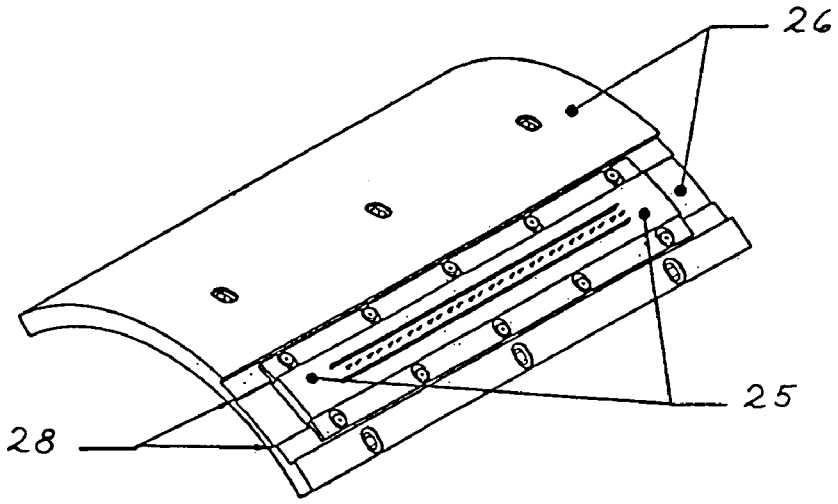
FIG. 9 is a prospective view of a die holder adaptor with sliding lock bars and inserted die.
Figure 10:
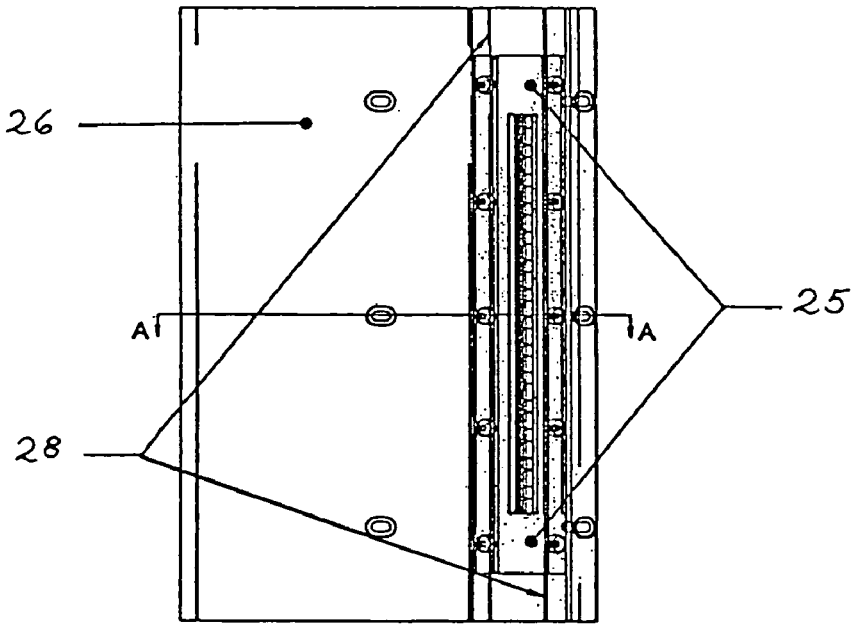
FIG. 10 is a top view of die holder adaptor with sliding lock bars and inserted die.
Figure 11:
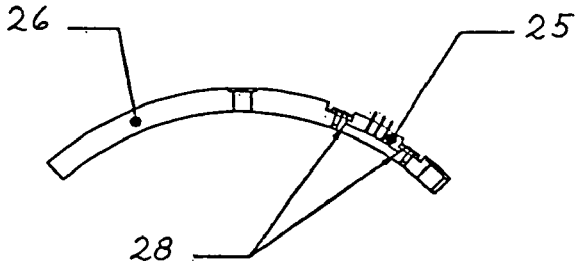
FIG. 11 is an end view of die holder adaptor with sliding lock bars and inserted die taken along line A-A of FIG. 10.
Figure 12:
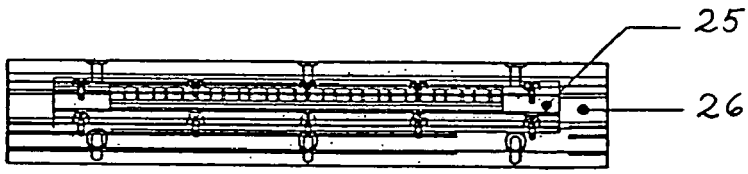
FIG. 12 is a side view of die holder adaptor with sliding lock bars and inserted die.
Figure 13:
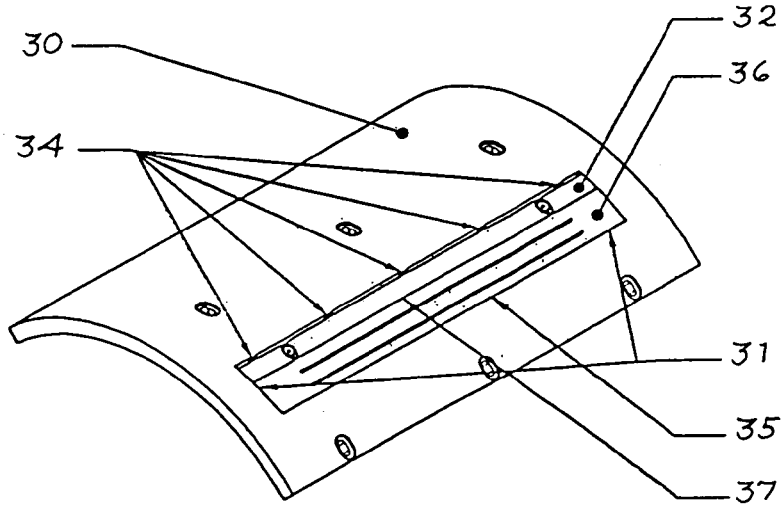
FIG. 13 is a prospective view of a die holder with a tuck-in side, a spring-enforced locking bar side and an inserted die.
Figure 14:
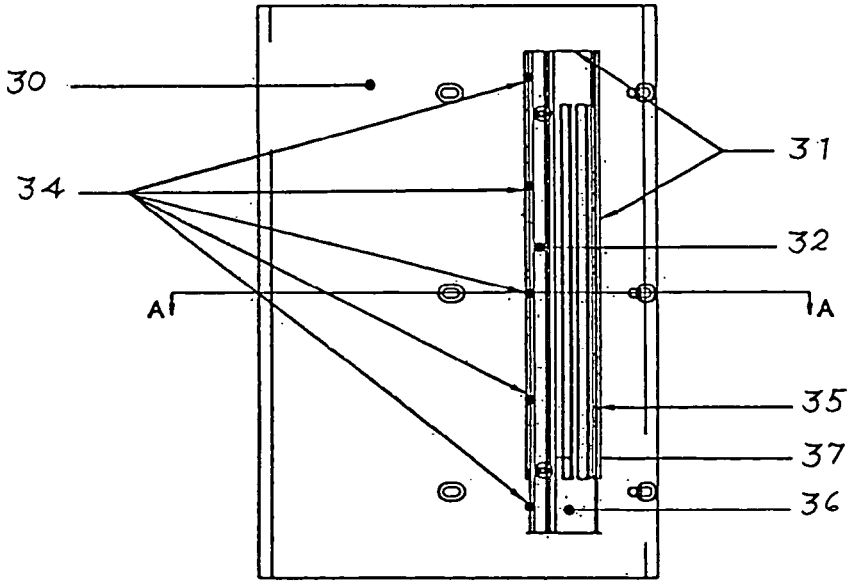
FIG. 14 is a top view of die holder with tuck-in side, spring-enforced locking bar side and inserted die.
Figure 15:
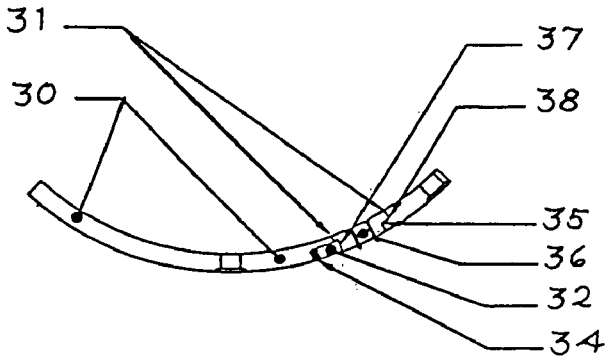
FIG. 15 is a cross sectional view of die holder with tuck-in side, spring-enforced bar locking bar side and inserted die taken along line A-A of FIG. 214
Figure 16:
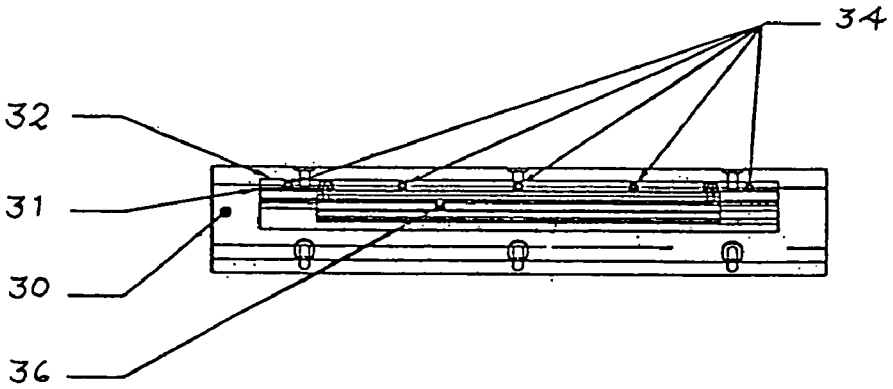
FIG. 16 is a side view of a die holder with a tuck-in side, a spring-enforced locking bar side and an inserted die.
Figure 17:
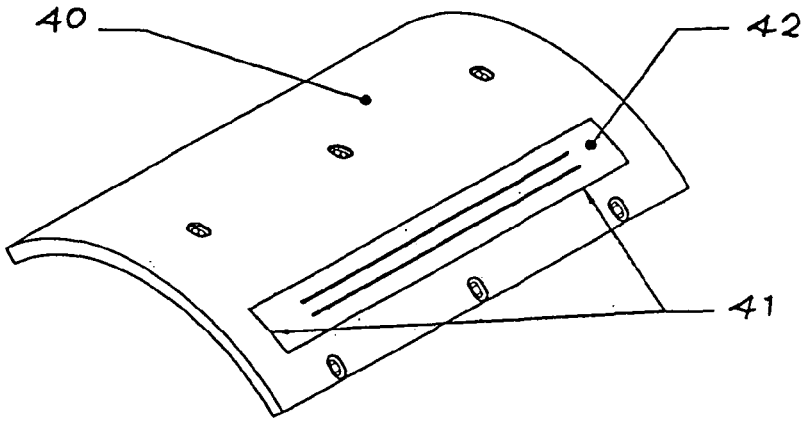
FIG. 17 is a prospective view of a die holder with snap-in die design and an inserted die.
Figure 18:
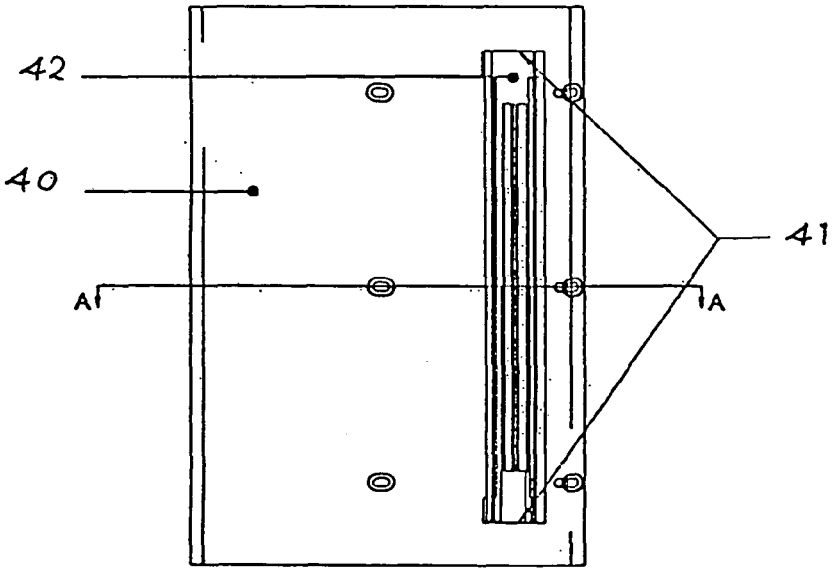
FIG. 18 is a top view of a die holder with snap-in die design and inserted die.
Figure 19:
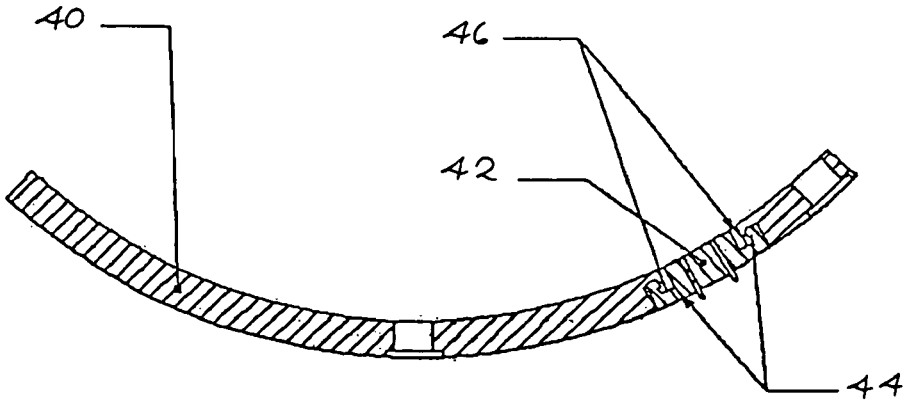
FIG. 19 is a cross sectional view of a die holder with snap-in die design and inserted die taken along line A-A of FIG. 18.
Figure 20:
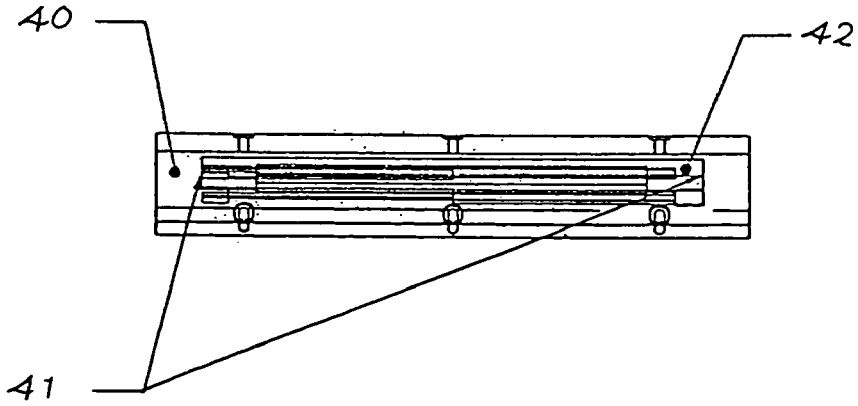
FIG. 20 is a side view of a die holder with snap-in die design and inserted die.
Figure 2I:
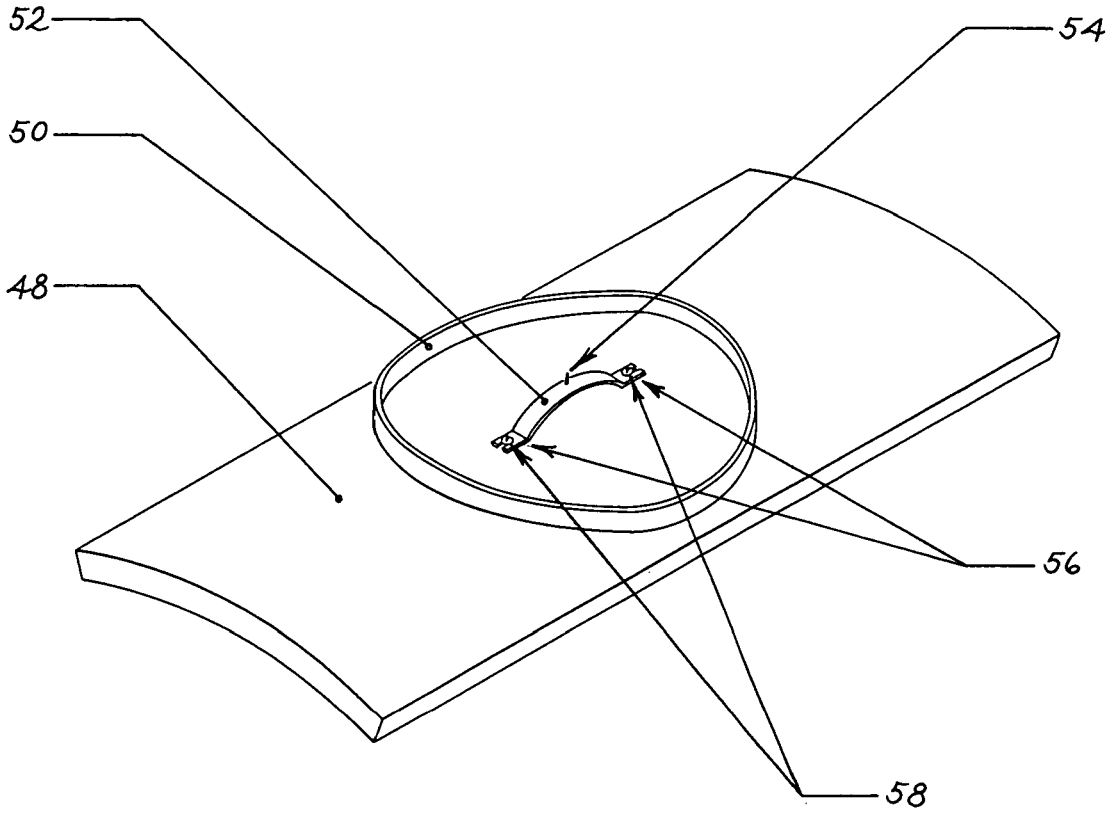
Figure 22:
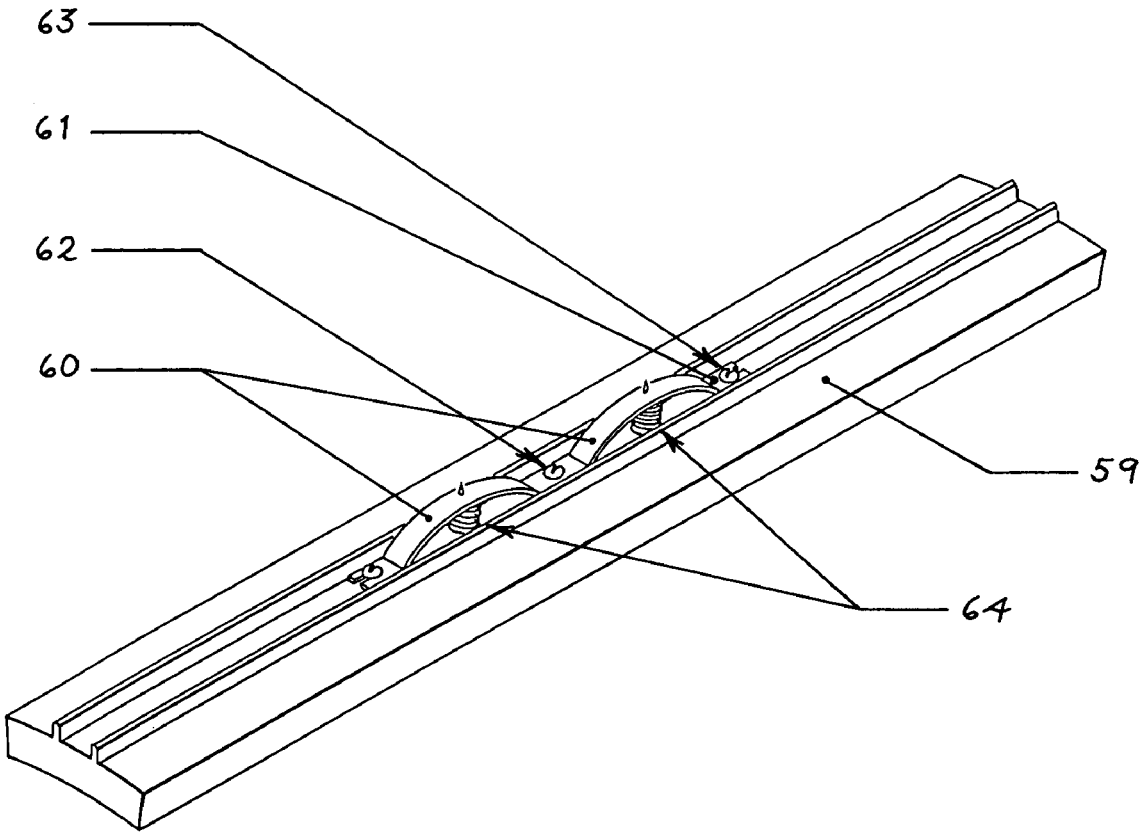
FIG. 22 is a double knife die with a flexible double-bowed stripper band.

FIG. 22 shows a perspective view of a cutting die 59 with a flexible, pointed, double bowed stripper band 60. The middle section of the band is secured to die 59 with a fastener 62. Slotted ends 61 of stripper band 60 fit securely under and around fasteners 63. Spring supports 64 are under the arcs of stripper band 60.

Figure 44:
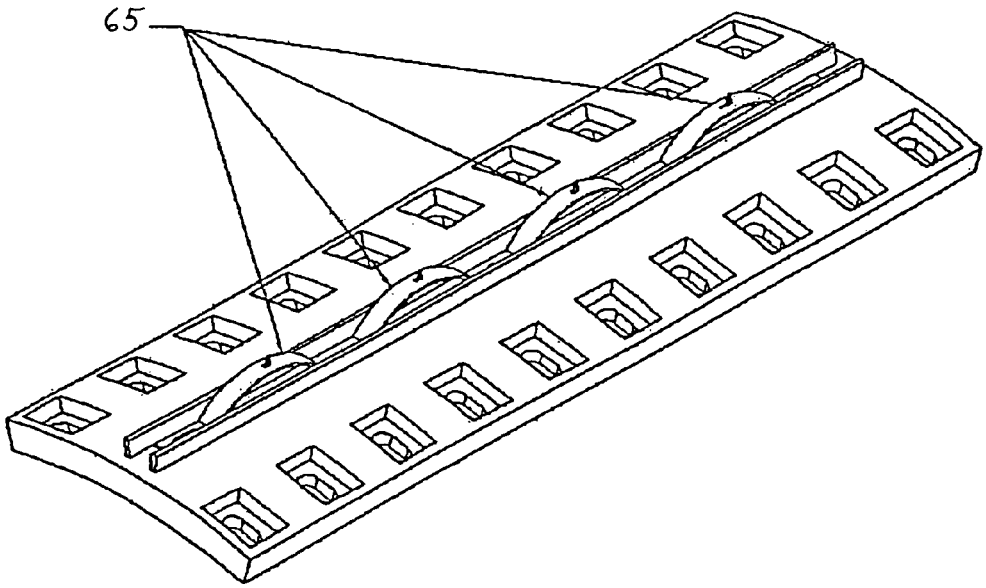
FIG. 44 is a perspective view of a double knife die with a multiple-bowed stripper band.
Figure 45:
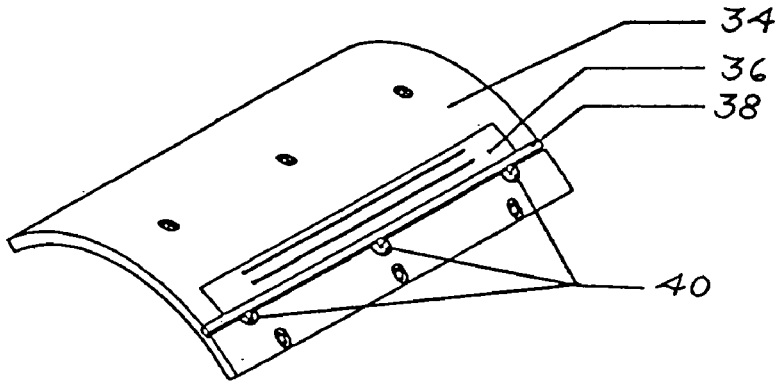
FIG. 45 is a perspective view of a die holder and die with a tuck-in side and a quick lock bar mechanism.
Figure 46:
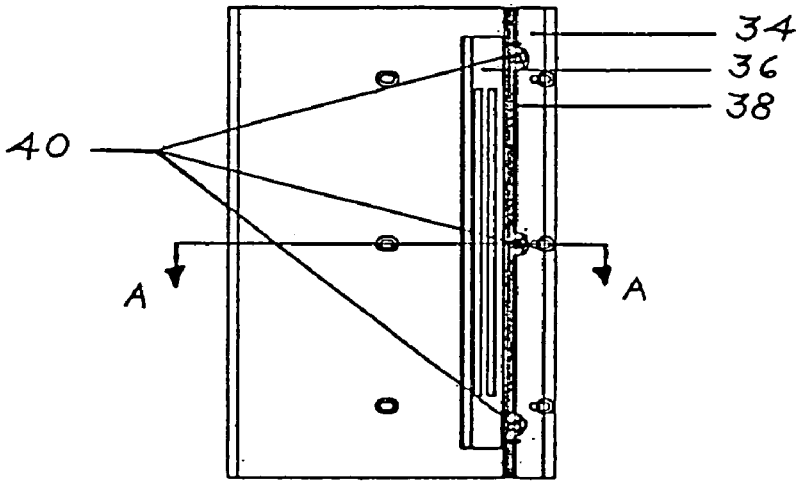
FIG. 46 is a top view of a die holder and die with a tuck-in side and a quick lock bar mechanism.
Figure 47:
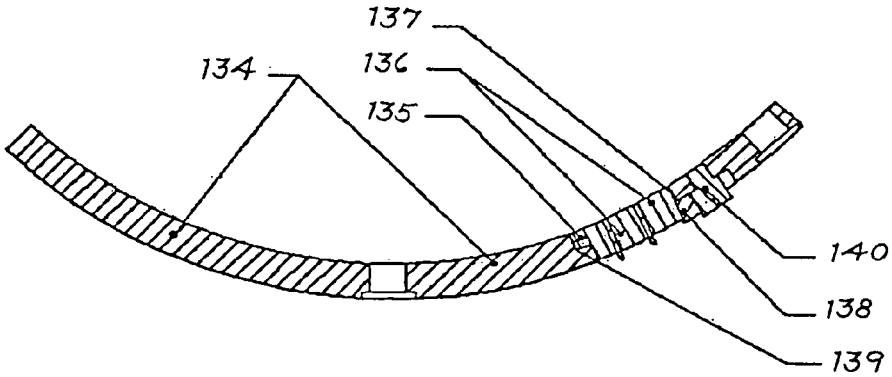
FIG. 47 is a cross sectional view of a die holder and die with a tuck-in side and a quick lock bar mechanism taken along line A-A of FIG. 46.
Figure 48:
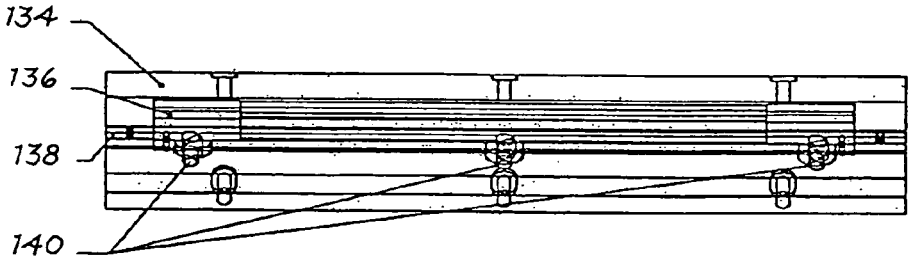
FIG. 48 is a side view of a die holder and die with a tuck-in side and a quick lock bar mechanism.
Figure 49:
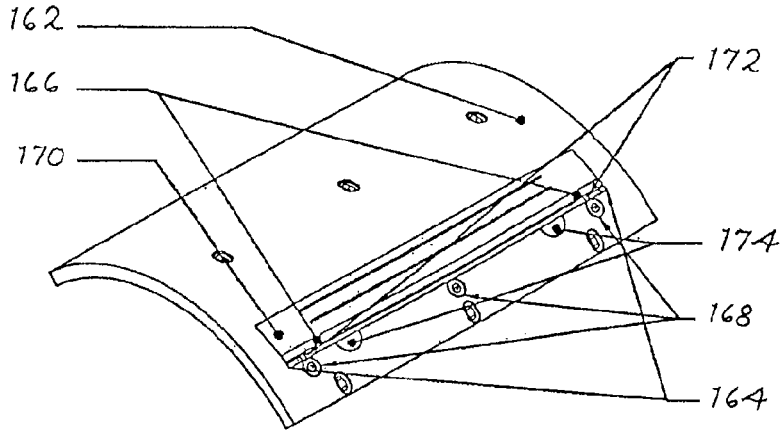
FIG. 49 is a perspective view of a cam lock die holder and die with free spinning cam and Z lock bar.
Figure 50:
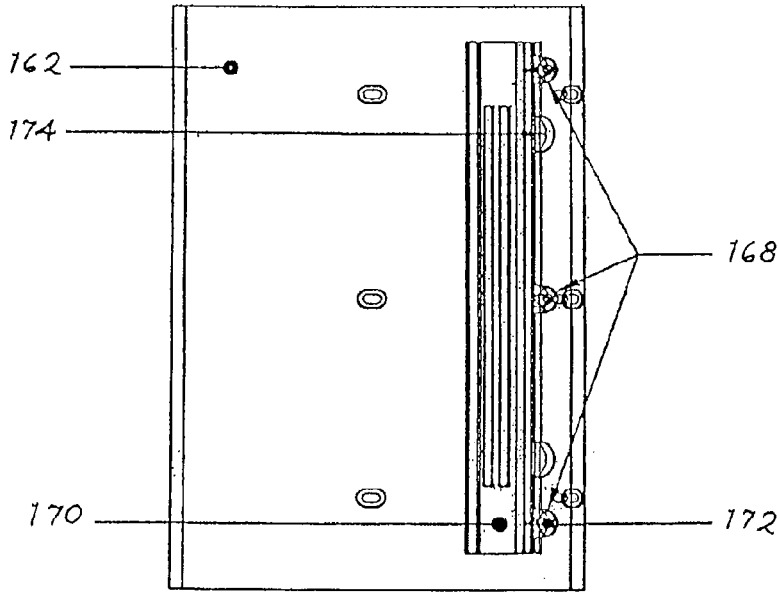
FIG. 50 is a top view of a cam lock die holder and die with free spinning cam and Z lock bar.
Figure 51:
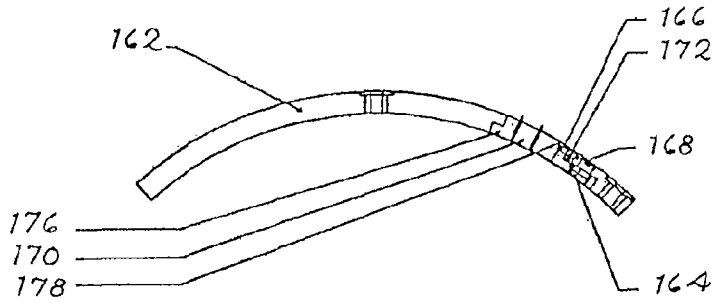
FIG. 51 is an end view of a cam lock die holder and die with free spinning cam and Z lock bar.
Figure 52:
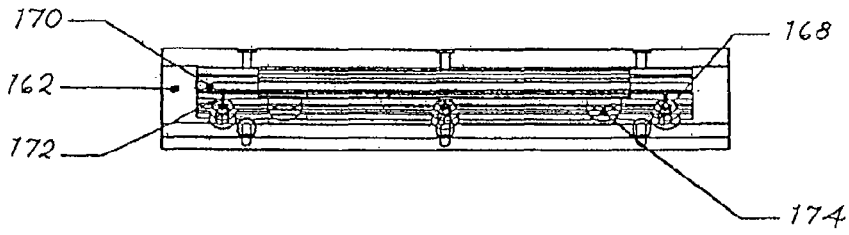
FIG. 52 is a side view of a cam lock die holder and die with free spinning cam and Z lock bar.
Figure 53:
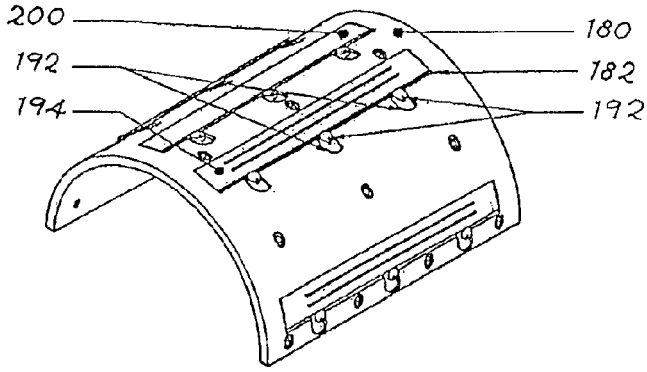
FIG. 53 is a perspective view of a cam lock die holder and dies with free spinning cam locks.
Figure 54:
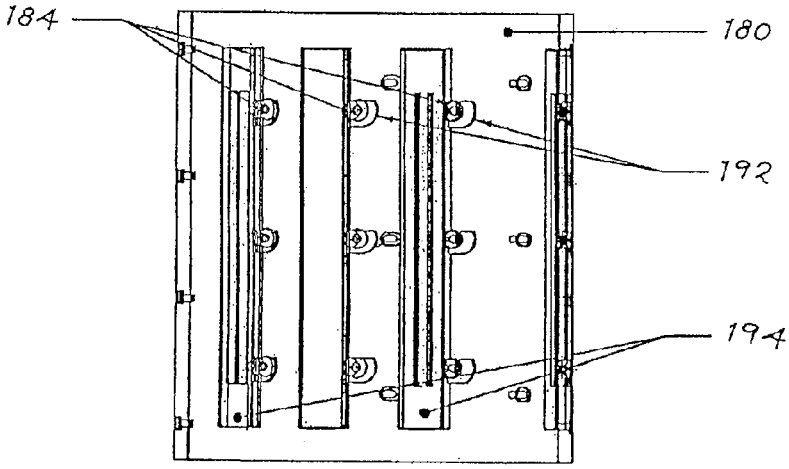
FIG. 54 is a top view of a cam lock die holder and dies with free spinning cam locks.
Figure 55:
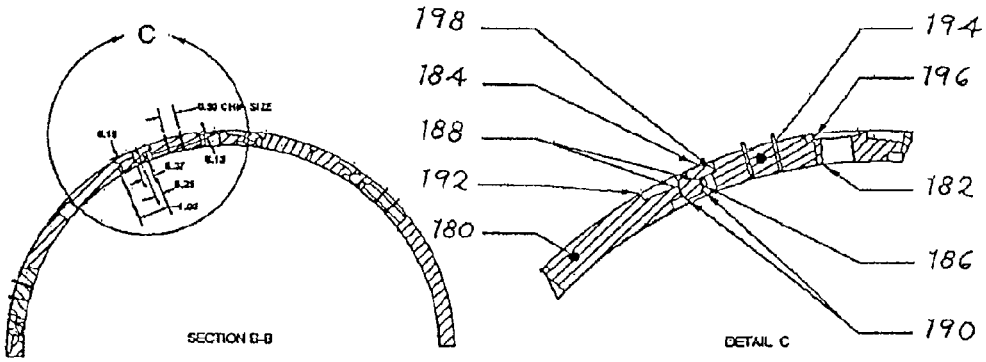
FIG. 55 is a cross sectional view of a cam lock die holder and dies with free spinning cam locks.
Figure 56:
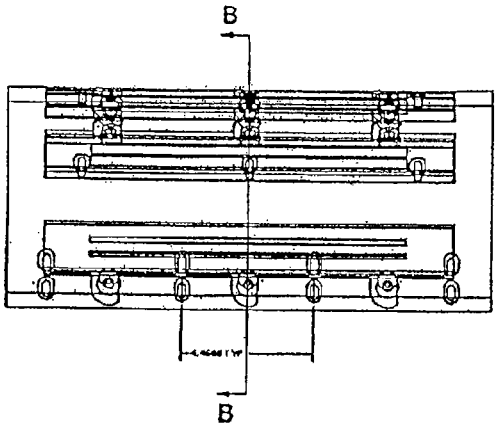
FIG. 56 is a side view of a cam lock die holder and dies with free spinning cam locks.

FIG. 44 is a perspective view of a double knife die with a multiple-bowed stripper band 65.

Figure 23:
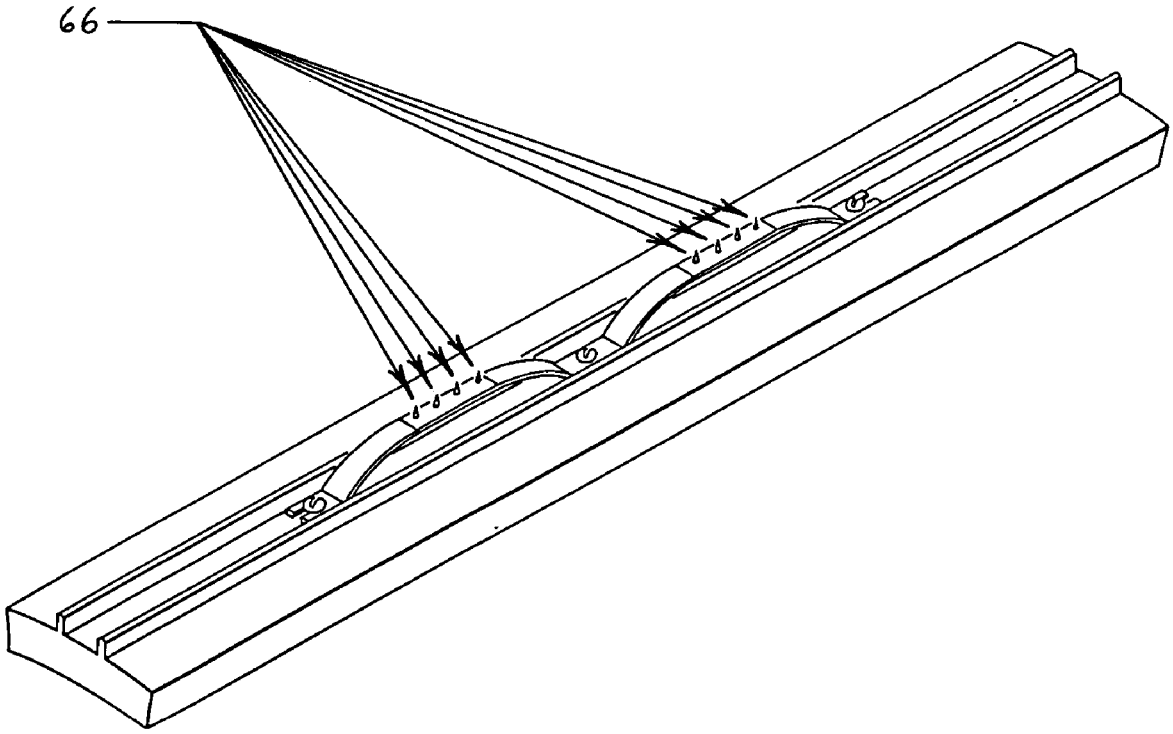
FIG. 23 is a double knife die with a multiple point, flexible, double-bowed stripper band.

FIG. 23 shows a perspective view of a cutting die with a flexible, pointed, multiple bowed stripper band with multiple points 66 at the peaks of the arcs of the stripper band.

Figure 24:
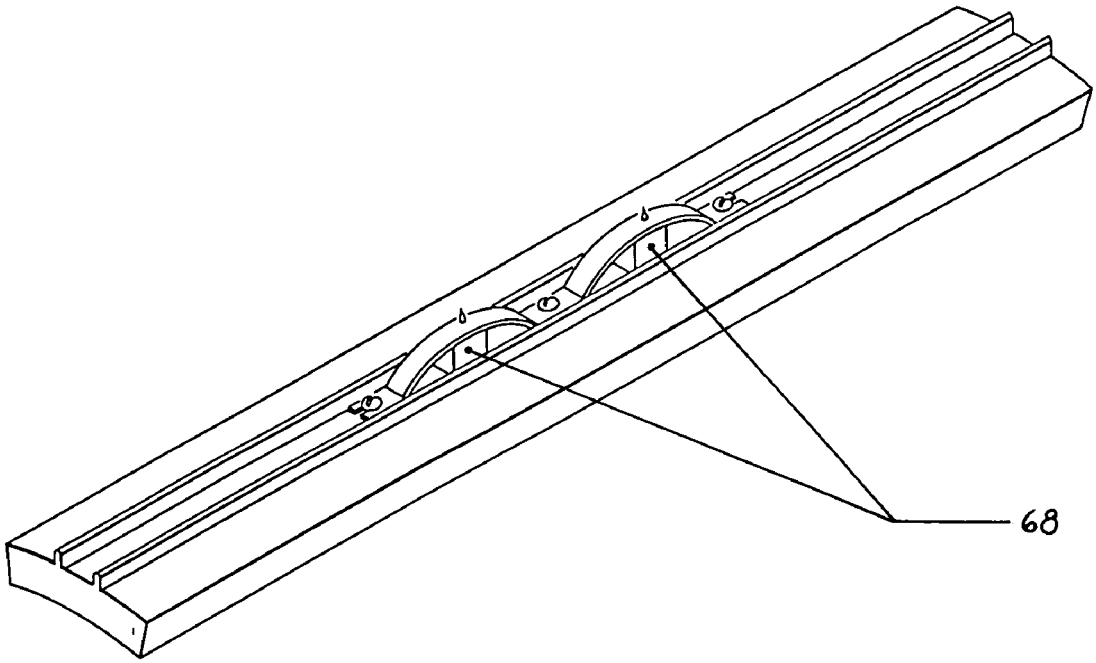
FIG. 24 is a double knife die with a rubber reinforced, flexible, double-bowed stripper band.

FIG. 24 shows a perspective view of a cutting die with a flexible, pointed, multiple bowed stripper band with rubber supports 68 under the arcs of the stripper band.

Figure 25:
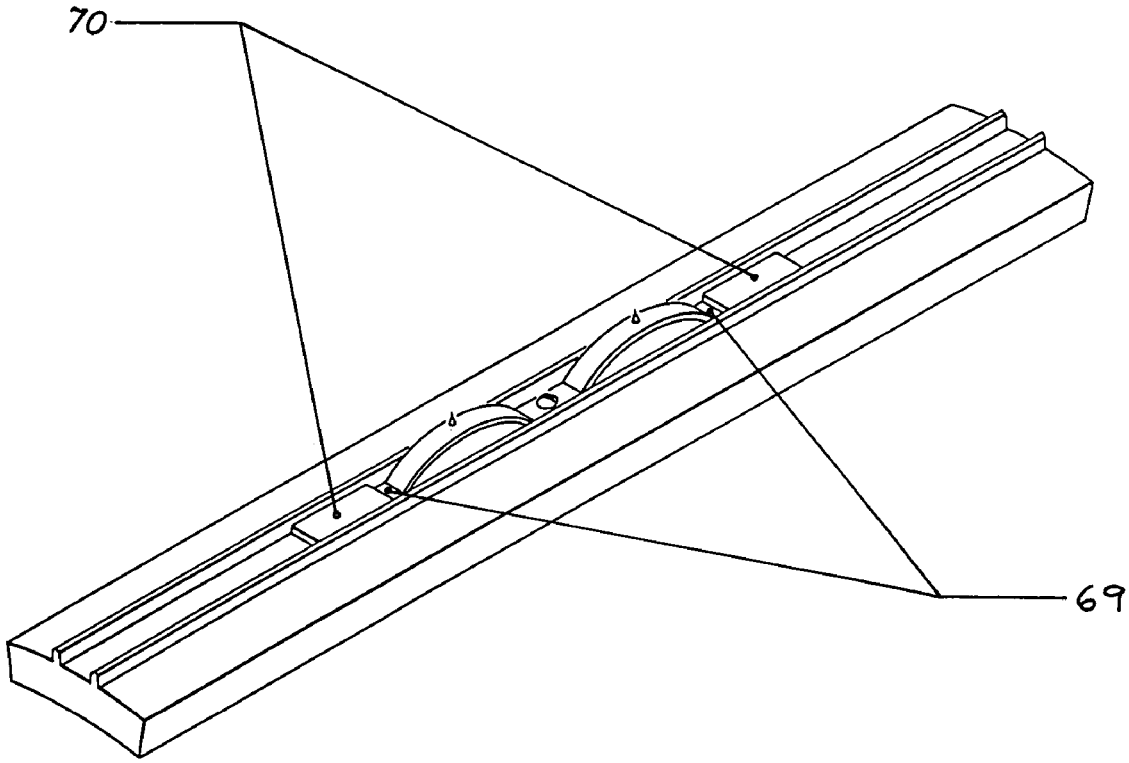
FIG. 25 is a double knife die with a flexible double-bowed stripper band, and slip-in end pockets.

FIG. 25 shows a perspective view of a cutting die with a flexible, pointed, multiple bowed stripper band. Ends 69 of the stripper band fit securely into fastener pockets 70 molded into the die.

Figure 32:
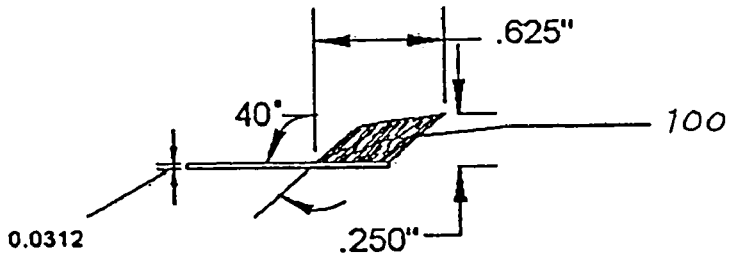
FIG. 32 is a side view of a stripper brush.
Figure 33:
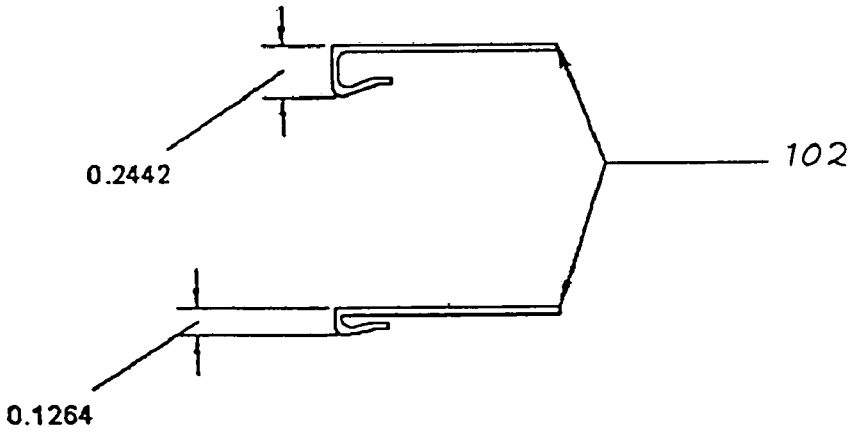
FIG. 33 is a side view of two styles of stripper clips.
Figure 34:
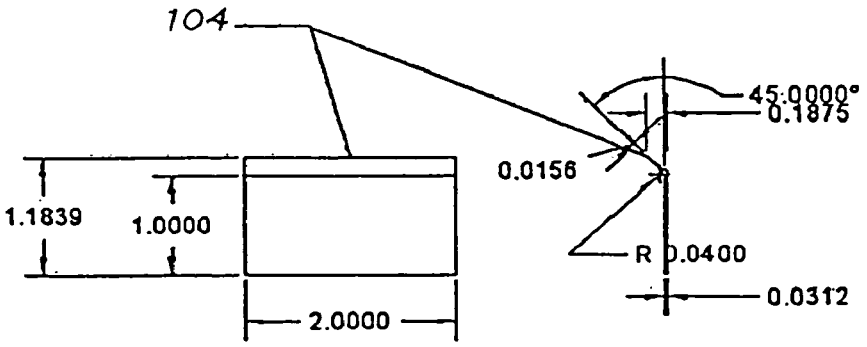
FIG. 34 is a top view and a side view of a stripper flap.
Figure 35:
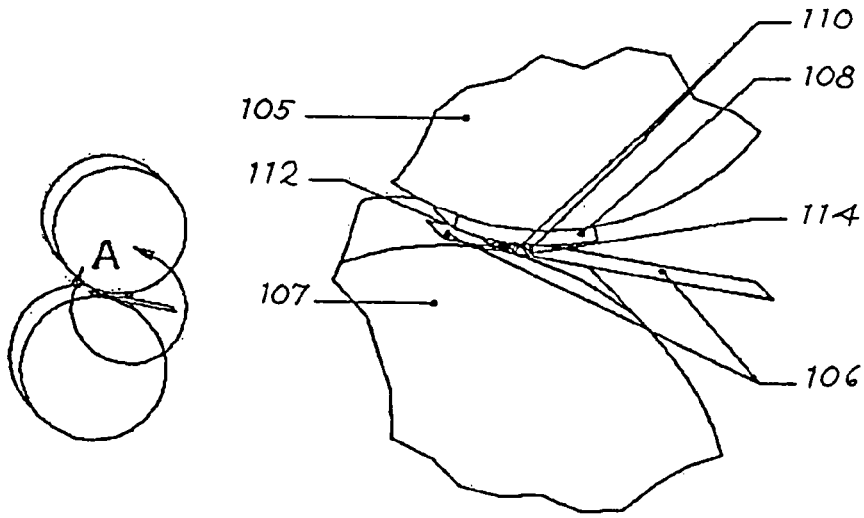
FIG. 35 is a partial perspective view of a stripper brush and stripper finger mounted to an anvil cylinder, and a cutting die mounted to a die cylinder with web material passing between the die cylinder and anvil cylinder.
Figure 36:
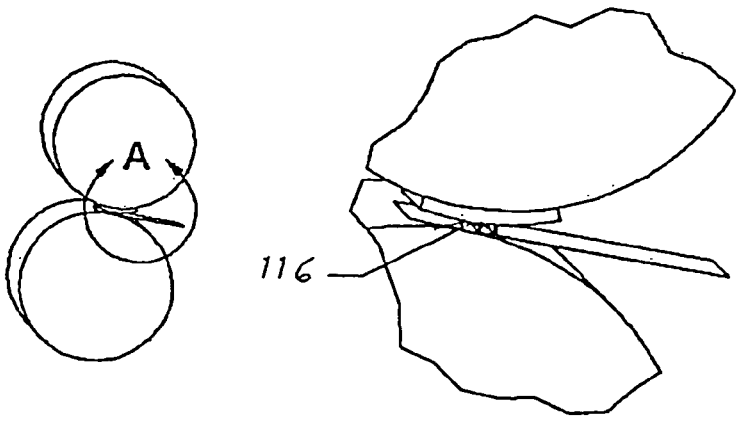
FIG. 36 is a partial perspective view of a stripper flap and stripper finger mounted to an anvil cylinder, and a cutting die mounted to a die cylinder with web material passing between the die cylinder and anvil cylinder.
Figure 37:
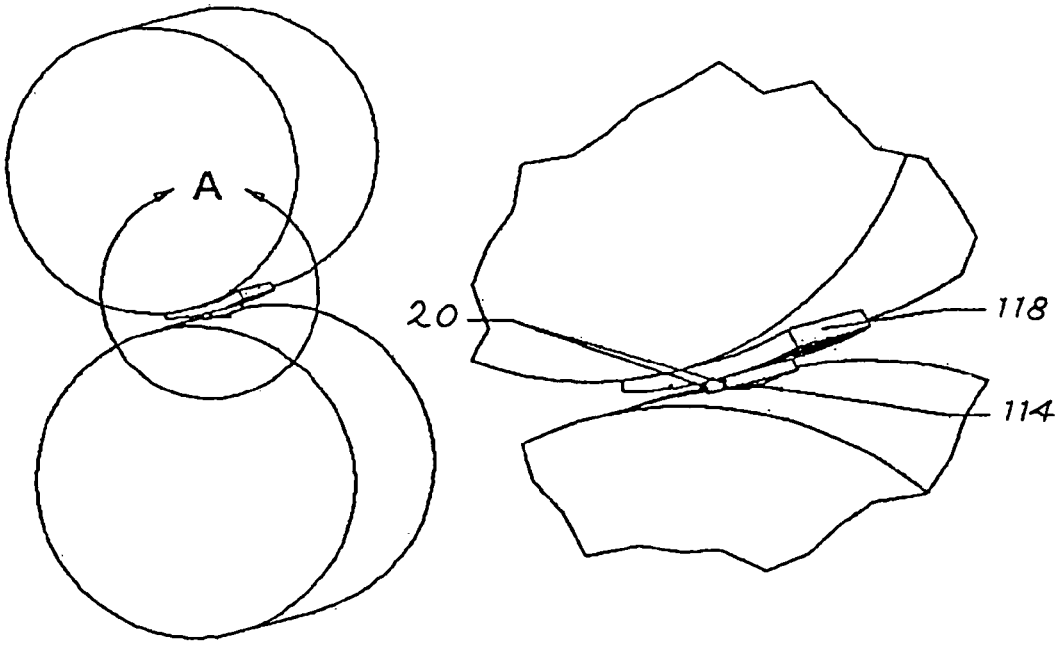
FIG. 37 is a partial perspective view of a stripper finger mounted to an anvil cylinder and an opposing die mounted to a die cylinder.

FIG. 35 shows a perspective view of a stripper brush 112 and a stripper finger 114 mounted to an anvil cylinder 107, and a cutting die 108 mounted to a die cylinder 105 with the web material 106 passing between the die cylinder and the anvil cylinder. Brush 112 and finger 114 are positioned to capture the "scrap" web material from between (and cut with) the die blades 110. A stripper brush 100 (FIG. 32), flap 104 (FIG. 34), flap 116 (FIG. 36), and clip 102 (FIG. 33) may be used in place of brush 112 in alternative embodiments.

Figure 38:
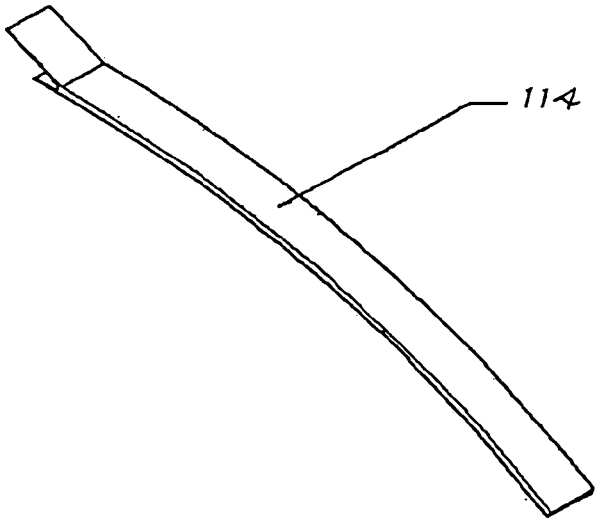
FIG. 38 is a perspective view of a stripper finger.
Figure 39:
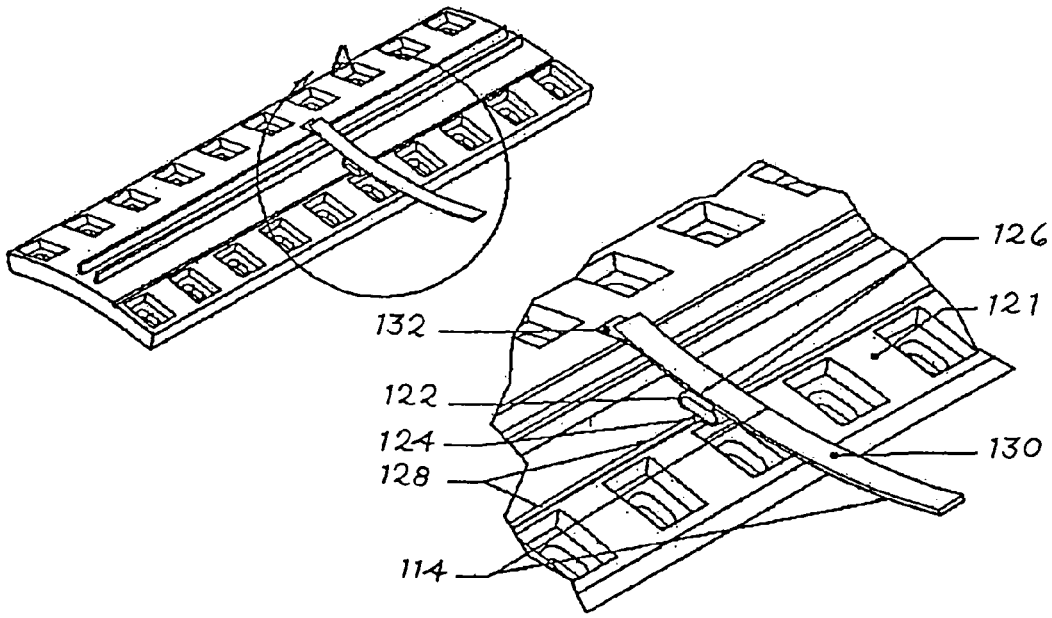
FIG. 39 is a perspective view of a stripper finger attached to a mounting tool which is attached to a die.
Figure 40:
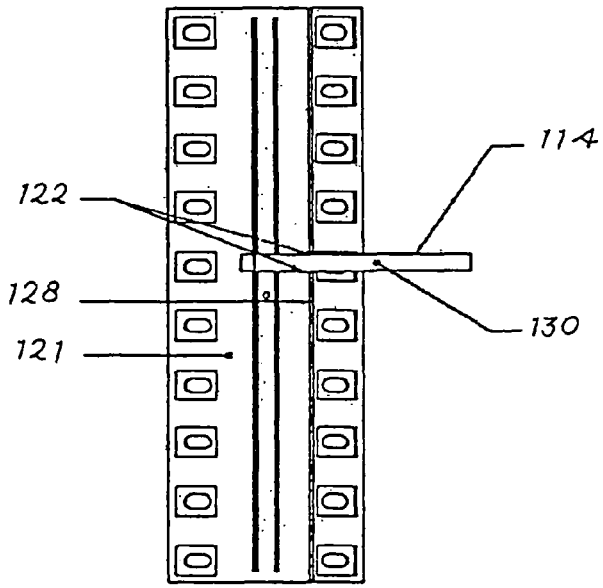
FIG. 40 is a top view of stripper finger attached to a mounting tool which is attached to a die.
Figure 41:
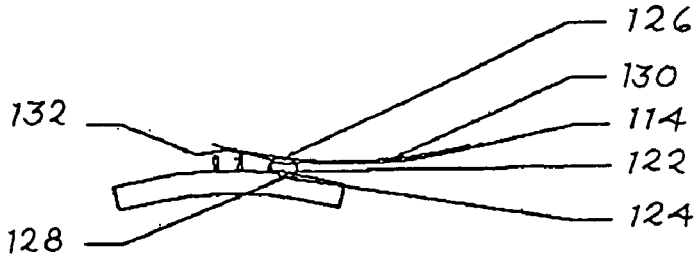
FIG. 41 is an end view of stripper finger attached to a mounting tool which is attached to a die.
Figure 42:
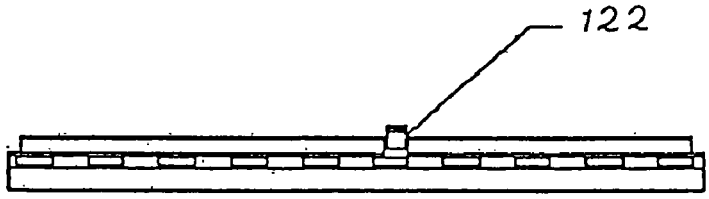
FIG. 42 is a side view of stripper finger attached to a mounting tool which is attached to a die.
Figure 43:
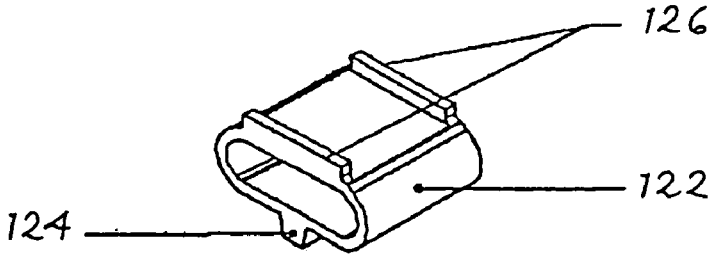
FIG. 43 is a perspective view of a stripper finger mounting tool.

FIGS. 39, 40, 41 and 42 show a perspective, top, end and side view, respectively, of stripper finger 114 (FIG. 38) attached to a mounting tool 122 that is attached to a die 121. On the die side of mounting tool 122 is a protrusion 124 inserted into a channel 128 in die 121. On the other side of mounting tool 122 is a clasp 126 to hold finger 114. Finger 114 has an appendage 132 for stripping material.

FIGS. 49, 50, 51 and 52 show a perspective, top, end and side view of a cam lock die holder 162 and die 170 with free spinning cam 168 and Z lock bar 166. Die 170 is positioned in a die holder opening 164. One edge 176 is tucked under holder 162 in opening 164 and the opposite edge 178 is secured by a locking bar 166 which is held in position by a plurality of cams 168. A plurality of thumb notches 174 are in holder 162 along edge of opening 164. A plurality of posts 172 pass through locking bar 166 from die holder 162.

FIGS. 53, 54, 55 and 56 show a perspective, top, cross sectional and side view of a cam lock die holder 180, a spacer 200 and dies 194 with free spinning locking cams 184. Die 194 is positioned in a die holder opening 182. One edge 196 is tucked under holder 180 in opening 182 and the opposite edge 198 is secured by a plurality of locking cams 184. A cam shaft 186 is inside of a metal sleeve 188 and held by a retention ring 190. The head of cam 184 is countersunk in a cavity 192.

As shown in FIGS. 30 and 31, the invention is used on rotary cutting machines having a die cylinder 78 and an anvil cylinder 80. A die holder 82 and die 86 are attached to die cylinder 78. A scrap removal mechanism 92 is attached to die 86. A web of material 98 passes between die cylinder 78 and anvil cylinder 80, and is cut by die blades 88. A scrap removal mechanism 92 impales web material scrap 99 against a resilient material 84 covering the anvil cylinder, and carries scrap 99 away from web 98. A stripper brush or comb 94 and vacuum chute 96 may be mounted near the path of the rotating scrap removal mechanism 92 to aid in removing scrap 99 from the scrap removal mechanism 92 as it passes by the stripper brush or comb 94 and vacuum chute 96.

In one embodiment, the die holder is made of a polyurea elastomer having a hardness of 60±5 (Shore D). However, other materials may be used.

In one embodiment, the locking bar is made of steel. However, other materials may be used.

To install the style of cutting dies shown in FIGS. 1-8, a user attaches die holder base 2 as they would normally attach a die to a die cylinder 78. The user then loosens fasteners 8 enough to slide the locking bars 12 away from cutout 5. The user then positions die 14 into cutout 5, and slides locking bars 12 over the edges of die base 14. The user fits locking bar lip 20 into notch 18 in the die base edge, then tightens fasteners, clamping locking bar 12 against die base 14, and securing die 14 and die holder 2 to die cylinder 78.

To eliminate or reduce the need for rubber that is otherwise added by the user, two half circumference die holders 22 (FIGS. 5-8) are attached to the die cylinder 78, circumventing the cylinder. The die holders 22 may remain attached to the die cylinder 78 when dies 21 are replaced. The multiple cutouts 23 of the base of a die holder 22 are predetermined at the time die holder 22 is made to accommodate the desired and/or most likely used die positions. With die holders 22 in place, the user is able to quickly insert and secure dies 21 to the proper location on the cylinder 78 according to the job requirements. Blank dies 24 are inserted into cutouts 23 where cutting dies 21 are not required.

A die holder adaptor 26 (FIGS. 9-12) may be used to attach dies 25 to an otherwise incompatible die cylinder 78. The die holder adaptor 26 is sized to fit the die cylinder 78 on a rotary cutting machine. Contours 28 in the base of the die holder adaptor are configured or adapted to fit the shape of the base of the dies 25. The user attaches die holder adaptor 26 to the die cylinder 78 with fasteners as they would normally attach a die, then inserts and secures dies 25 into the die holder adaptor.

To install a tuck-in style die 36 (FIGS. 13-16), the user attaches a die holder 30 to a die cylinder 78 with fasteners as they would normally attach a die. The user inserts an edge 35 of die 36 into an indentation 38 in the base of a die holder 30, pulls back a locking bar 32 to allow the other edge 37 of die 36 to be placed into cutout 31, positions die 36 in cutout 31, and then positions and secures locking bar 32 over die edge 37.

A spacer 76 (FIGS. 28, 29) may be used to fill in extra space and secure the die 36 when die 36 is substantially smaller than the cutout 31. In one embodiment, the die is made of a polyurea elastomer having a hardness of 60±5 (Shore D). The user installs spacer 76 between the contour edge 75 of the die and the contour edge 77 of the die holder in the same way that the user installs tuck-in die 36 as described above.

To install a snap-in style die 42 (FIGS. 17-20), the user attaches a die holder 40 to a die cylinder 78 with fasteners as they would normally attach a die. The user inserts die 42 into a cutout 41 of the base of die holder 40. Contoured edges 44 of the base of die 42 fit securely into and around the contoured edges 46 of the base of the die holder 40.

A blade backer strip 72 (FIGS. 26, 27) is used in a die holder adaptor 71 to distribute the force exerted through the blades of a die 73 to die holder adaptor 71. In one embodiment, the blade backer strip 72 is made of steel. The user attaches die holder adaptor 71 to the die cylinder 78 with fasteners as they would normally attach a die, inserts blade backer strip 72 into an indentation 74 in the base of die holder adaptor 71, and then inserts and secures die 73 into die holder adaptor 71.

To install a tuck-in style die 136 (FIGS. 45-48), the user attaches a die holder 134 to die cylinder 78 as they would normally attach a die. The user inserts an edge 135 of die 136 into an indentation 139 in the base of a die holder 134, pulls back a locking bar 138 to allow the other edge 137 of die 136 to be placed into holder 134, positions die 136 in holder 134, then positions locking bar 138 over die edge 137 and secures it with a plurality of locking screws 140.

To install a cam lock die 170 (FIGS. 49-52), the user positions a die holder 162 with a locator bar (not shown) and secures the die holder 162 to a die cylinder with a plurality of fasteners as they would normally attach a die. The user inserts a die 170 into a die holder opening 164, tucking one edge 176 under holder 162. The user secures die 170 with locking bar 166 by turning a plurality of cams 168 that slide locking bar 166 over a die edge 178. A plurality of thumb notches 174 in holder 162 allow easy insertion and removal of die 170. A plurality of posts 172 passing through locking bar 166 from die holder 162 add stability and security to the die locking system.

To install a cam lock die 194 (FIGS. 53-56), the user positions and secures a die holder 180 as they would with die holder 162. The user inserts a die 194 into a die holder opening 182, tucking one edge 196 under holder 180. The user secures die 194 by turning a plurality of cams 184 that slide over a die edge 198.

Figure 57:
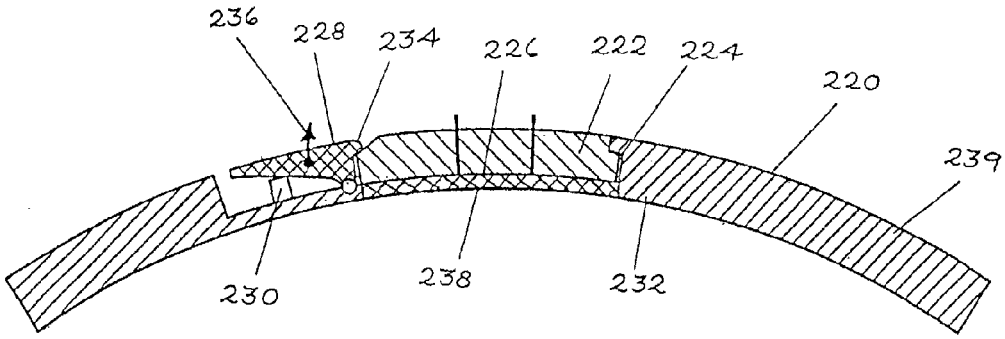
FIG. 57 is a cross sectional view of a centrifugal lock die holder and cutting die with a centrifugal lock in the locked position.
Figure 58:
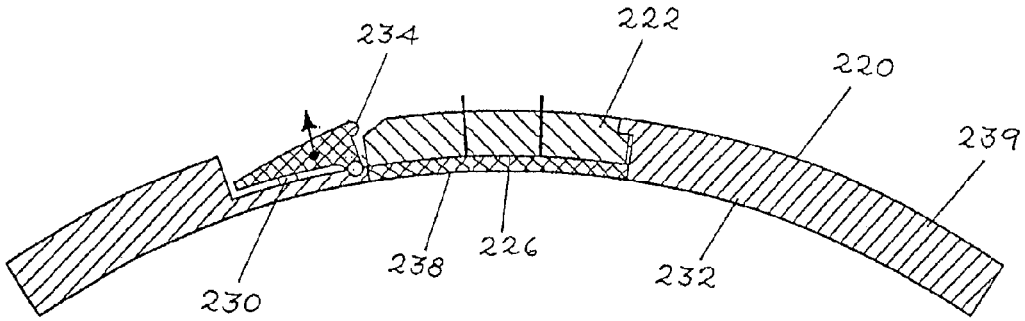
FIG. 58 is a cross sectional view of a centrifugal lock die holder and cutting die with a centrifugal lock in the unlocked position.

FIGS. 57 and 58 show cross sectional views of a centrifugal lock die holder 220 for securing cutting die 222 to a rotary cutting cylinder (not shown). The die holder 220 comprises a an indentation 224 along one side of the recess 226 into which one edge of the base 232 of the cutting die 222 is laterally inserted and secured. The opposite edge of the base 232 of the cutting die 222 is secured by a centrifugal lock 228 that is rotatably attached to the base of the die holder. The centrifugal lock 228 is rotatable between a first position (shown in FIG. 57) wherein the cutting die 222 is secured to the die holder, and a second position (shown in FIG. 58) wherein the cutting die 222 can be removed from (or inserted into) the recess 226 of the die holder 220.

In the particular embodiment illustrated, the centrifugal lock 228 includes a retaining lip 234 that engages with and upper portion of the cutting die 222 when in the first position so as to retain the cutting die 222 within the recess 226. A spring 230 is disposed between centrifugal lock 228 and the base 232 of the die holder so as to bias the centrifugal lock 228 in the first position. In addition, the centrifugal lock 228 has a center of mass 236 that is offset from the axis of rotation so that centrifugal forces acting on the centrifugal lock 228, as a result of rotation the rotary cutting cylinder, bias the centrifugal lock 228 in the first position. In particular, and with specific reference to FIG. 57, the center of mass 236 is disposed so that the outwardly directed centrifugal force causes the centrifugal lock to rotate clockwise towards the first or closed position. Thus, the faster the rotation of the rotary cutting cylinder, the larger the closing force of the centrifugal lock 228.

The base 232 of the die holder 220 comprises a plurality of portions manufactured from different materials or having different physical properties. For example, and as illustrated in FIGS. 57 and 58, the base 232 comprises a first portion 238 below the recessed area 266 manufactured from a first material, and a second portion 239 adjacent to the recessed area 226 manufactured from a second material. The first material may comprise an impact absorbing material such as plastic or rubber that is adapted to absorb the force transmitted to the base 232 by the cutting die 222. The second material may comprise a more rigid material such as aluminum to provide overall rigidity to die holder 220. The inclusion of an impact absorbent material in the first portion 238 of the base 232 below the cutting die 222 eliminates the need for a separate impact absorbing layer (e.g., rubber) between the die holder 220 and the rotary cutting cylinder. In an alternative design, the first portion 238 below the recessed area 266 comprises a multi-layer material having an impact absorbent material layered on top of (over) a more rigid material. For example, the entire base 232 may comprise a uniform material such as aluminum with a rubber pad disposed on top of the first portion of the 238 along the bottom of the recessed area 266. It should also be understood that the use of different materials for different portions of the die holder base, as described above, can be utilized in any of the previously described embodiments.

Figure 59:
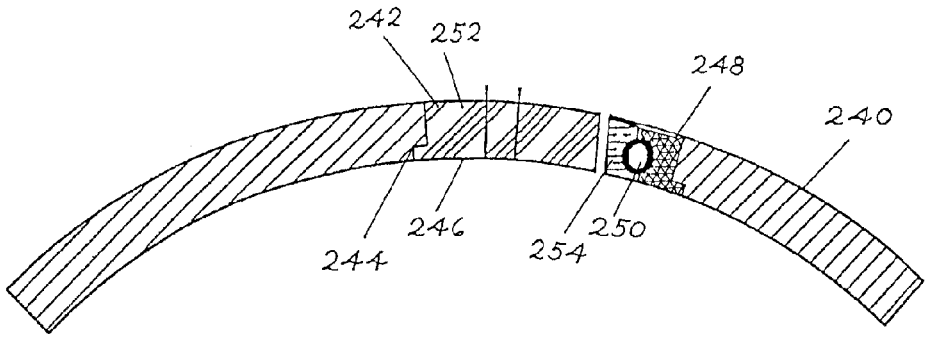
FIG. 59 is a cross sectional view of a bladder lock die holder and cutting die with a bladder lock in the unlocked position.
Figure 60:
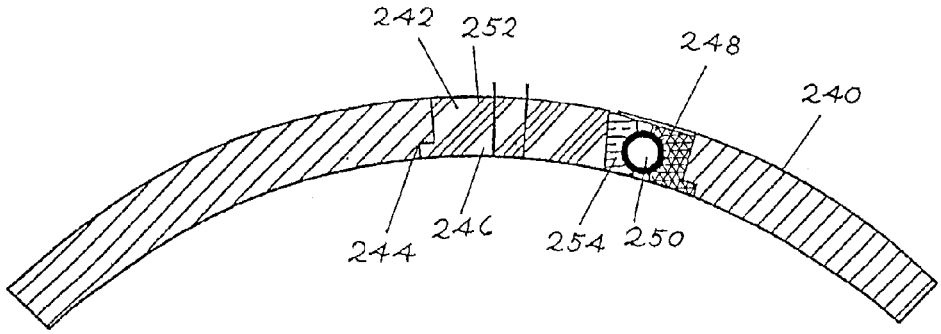
FIG. 60 is a cross sectional view of a bladder lock die holder and cutting die with a bladder lock in the locked position.

FIGS. 59 and 60 show perspective views of a bladder lock die holder 240 for securing cutting die 242 to a rotary cutting cylinder (not shown). The die holder 240 comprises a an indentation 244 along one side of the recess 246 into which one edge of the base 252 of the cutting die 242 is laterally inserted and secured. The opposite edge of the base 252 of the cutting die 242 is secured by a bladder lock 248 that is secured attached to the base of the die holder. The bladder lock 248 is movable between a first position (shown in FIG. 60) wherein the cutting die 242 is secured to the die holder, and a second position (shown in FIG. 59) wherein the cutting die 242 can be removed from (or inserted into) the recess 246 of the die holder 240. The bladder lock 248 is moved or actuated by a change in fluid pressure within a chamber 250 inside the bladder lock 248. In particular, a fluid is injected into the chamber 250 so as to move an edge 254 of the bladder lock 248 towards and into engagement with the cutting die 242. The cutting die 242 is released by removing or reducing the fluid pressure within the chamber 250 of the bladder lock 248. In the embodiment illustrated, the chamber 250 comprises an air bladder that is filled with air. The pressure of the air within the chamber 250 is increased to move the bladder lock 248 from the second position to the first position, and is reduced to move the bladder lock 248 from the first position to the second position.

Various scrap removal mechanisms may also be incorporated into the die. With reference to FIG. 21, a flexible, pointed, bowed stripper band 52 is installed onto a base 48 of a contour cutting die by positioning the slotted ends 56 of stripper band 52 under and around fasteners 58. The user secures the ends 56 by tightening the fasteners 58. The point 54 on the band 52 should be directed away from the base 48 in order to impale scrap 99 and carry it to the stripper comb 94 and scrap removal chute 96. The band 52 pushes scrap 99 away from die blade 50 in order to separate scrap 99 from the web of material 99. The band 52 can be removed by loosening fasteners 58 and pushing ends 56 inward to slide from under the fasteners 58.

One embodiment of the stripper band is made of steel. The points are cut and bent up from the strip.

With reference to FIG. 22, a flexible, pointed, multiple bowed stripper band 60 is installed in a cutting die 59 in a similar way to band 52. The user positions the slotted ends 61 of stripper band 60 under and around fasteners 63, and secures the ends 61 by tightening the fasteners 63. The user then secures the middle section of the band to die 59 with a fastener 62. The band 60 can be removed by loosening fasteners 63, removing fastener 62, and then pushing ends 61 inward to slide from under the fasteners 63. The user may insert springs 64 or rubber 68 (FIG. 24) under the arcs of stripper band 60 for additional support.

FIG. 25 shows a different embodiment wherein the user inserts the ends 69 of the stripper band into fastener pockets 70 molded into the die to secure the ends 69.

In different style scrap removal system (FIGS. 32-43), a stripper finger 114 is used in conjunction with a stripper brush 112 to remove and carry "scrap" from a web material 106. Brush 112 and finger 114 are positioned to capture the scrap web material from between the die blades 110.

Finger 114 is positioned and attached to an anvil cylinder 107 with the use of a mounting tool 122. Finger 114 is held by a clasp 126 to mounting tool 122. Mounting tool 122 is attached by a protrusion 124 to a channel 128 in a die 121. An adhesive is used to attach an anvil cylinder side of finger 114 to anvil cylinder 107. A die cylinder 105 and anvil cylinder 107 are rotated until side of finger 114 adheres to anvil cylinder 107. Mounting tool 122 is removed before cutting operation begins. Brush 112 is positioned and attached to cylinder 107 in order to form a pocket with an appendage 132 on finger 114 around a die blade 110 to carry "scrap" from a web material 106. A stripper brush 100 (FIG. 32), flap 104 (FIG. 34), flap 116 (FIG. 36), and clip 102 (FIG. 33) may be used in place of brush 112 in alternative embodiments.

It should be understood that variations and alternative methods of embodying the present invention are contemplated. For example, various materials, such as steel, aluminum, plastic or epoxy, may be used to make the die base. Various materials, such as plastic, rubber, wood, steel or aluminum, may be used to make the die holder and blade backer strip. Various materials, such as plastic, wood, steel or aluminum, may be used to make the locking bar. Various materials, such as plastic, steel or other metals may be used to make the stripper band. And various materials, such as urethane may be used to reinforce the stripper band.

The locking bar can be drawn toward the die with magnets rather than pushed toward the die with springs. Various configurations, such as parallel or perpendicular bent points or pin inserts, may be used for the stripper band points. The ends of slotted stripper bands may be secured to the die with fixed posts rather than screw down fasteners. The die holder and die holder adaptor may be used to hold various shapes, sizes, makes and types of dies, including epoxy, steel, and mechanical. And the dies, die holders, die holder adaptors and scrap removal mechanisms may be used on various shapes, sizes, makes and types of rotary cutting machines, including those with the die cylinder under the anvil cylinder.

It is therefore intended that the foregoing detailed description be regarded as illustrative rather than limiting, and that it be understood that it is the following claims, including all equivalents, that are intended to define the spirit and scope of this invention.

The invention claimed is:

1. A die holder system for securing a rotary cutting die to a rotary die cylinder, said die holder system comprising:

a rotary cutting die comprising a cutting blade fixedly mounted to a curved cutting die base, the cutting die base comprising an edge disposed along the perimeter thereof, a die holder comprising a curved holder base having a lower surface and an upper surface, the lower surface being configured to be mounted on a rotary die cylinder, the upper surface comprising a recessed area configured for receiving the cutting die base of the rotary cutting die, the recessed area having a depth that is equal to a thickness of the cutting die base and equal to a thickness of the curved holder base so that an upper surface of the cutting die base is flush with the upper surface of the die holder base and a lower surface of the die base is mountable against the rotary die cylinder, said cutting blade having a lower edge coincident with the lower surface of the cutting die base, wherein the die holder further comprises a first mounting system for removably securing the die holder to the rotary die cylinder, and a second mounting system for removably securing the cutting die base of the rotary cutting die to the die holder by engaging the edge of the cutting die base at a plurality of spaced apart locations, the second mounting system being configured so as to not project above the upper surface of the holder base and not project below the lower surface of the holder base, and wherein said cutting blade is fixed to said cutting die base when said rotary cutting die Is not mounted to said die holder.

2. The die holder system according to claim 1 wherein the upper surface of the holder base comprises a plurality of spaced apart recessed areas configured for receiving a plurality of cutting dies.

3. The die holder system according to claim 1 wherein the first mounting system comprises a plurality of first fasteners configured to secure the holder base to the rotary die cylinder, the plurality of first fasteners being spaced apart from the recessed area and configured so as to not project above the upper surface of the holder base when the die holder is secured to the rotary die cylinder.

4. The die holder system according to claim 1 wherein the second mounting system comprises a plurality of second fasteners configured to secure the cutting die to the die holder.

5. The die holder system according to claim 1 wherein the second mounting system comprises a contoured portion disposed along each of two opposite sides of the recessed area of the holder base, each contoured portion configured to receive and secure the cutting die base of the cutting die to the die holder with a snap-in arrangement.

6. The die holder system according to claim 1 wherein the second mounting system comprises an indentation disposed along a side of the recessed area of the die holder, the indentation configured to laterally receive and secure a first edge of the cutting die base to the die holder at a first location.

7. The die holder system according to claim 6 wherein the second mounting system further comprises a mechanism configured to secure an opposite edge of the cutting die base to the die holder, the opposite edge being at a location opposite the first location with the cutting blade being disposed there between.

8. The die holder system according to claim 7 wherein the mechanism comprises a plurality of second fasteners configured to extend through the cutting die base of the rotary cutting die.

9. The die holder system according to claim 7 wherein the mechanism comprises a plurality of cams rotatably attached to the die holder, the cams being rotatable between a first position and a second position, the first position configured to engage the opposite edge of the cutting die base and secure the cutting die base to the die holder, the second position configured to disengage from the opposite edge of the cutting die base and permit the cutting die base to be removed from the die holder.

10. The die holder system according to claim 9 wherein the plurality of cams each comprise an axis of rotation that is transverse to an axis of rotation of the rotary die cylinder and are configured to laterally engage an indentation in the opposite edge of the cutting die base.

11. The die holder system according to claim 7 wherein the mechanism comprises a centrifugal lock rotatably attached to the die holder, the centrifugal lock being moveable between a first position and a second position, the first position configured to engage and secure the opposite edge of the cutting die base of the cutting die to the die holder, the second position configured to permit the cutting die to be removed from the die holder.

12. The die holder system according to claim 11 wherein the centrifugal lock comprises an axis of rotation that is parallel to an axis of rotation of the rotary die cylinder.

13. The die holder system according to claim 12 wherein the centrifugal lock comprises a center of mass that is offset from its axis of rotation such that centrifugal force acting on the centrifugal lock due to rotation of the rotary die cylinder biases the centrifugal lock in the first position.

14. The die holder system according to claim 11 wherein the centrifugal lock further comprises a spring for biasing the centrifugal lock in the first position.

15. The die holder system according to claim 7 wherein the mechanism comprises a fluid actuated device that is moveable between a first position and a second position upon a change in fluid pressure within the device, the first position configured to engage and secure the opposite edge of the cutting die base of the cutting die to the die holder, the second position configured to permit the cutting die to be removed from the die holder.

16. The die holder system according to claim 15 wherein the fluid actuated device comprises an air bladder that is moveable between the first position and the second position upon a change in air pressure within the air bladder.

17. The die holder system according to claim 1 wherein a first portion of the holder base is disposed below the recessed area, and a second portion of the holder base is disposed adjacent to the recessed area, further wherein the first portion and the second portion comprise different materials.

18. The die holder system according to claim 17 wherein the first portion comprises a first material that is an impact absorbing material, and the second portion comprises a second material that is more rigid than the first material.

19. The die holder system according to claim 17 wherein the first portion comprises a multi-layered material including an impact absorbing material, and the second portion comprises a second material that is more rigid than the first material.

* * * * *